US012330202B1

(12) United States Patent
Yan et al.

(10) Patent No.: US 12,330,202 B1
(45) Date of Patent: Jun. 17, 2025

(54) PROCESSING DEVICE FOR FLANGE

(71) Applicant: SHANXI SHUANGHUAN HEAVY INDUSTRY GROUP CO. LTD, Dingxiang County (CN)

(72) Inventors: Xingyue Yan, Dingxiang County (CN); Chenyang Yan, Dingxiang County (CN); Aie Liang, Dingxiang County (CN); Jiangyong Zhao, Dingxiang County (CN); Yujia Han, Dingxiang County (CN); Bing Liang, Dingxiang County (CN)

(73) Assignee: SHANXI SHUANGHUAN HEAVY INDUSTRY GROUP CO. LTD, Dingxiang County (CN)

( * ) Notice: Subject to any disclaimer, the term of this patent is extended or adjusted under 35 U.S.C. 154(b) by 0 days.

(21) Appl. No.: 18/919,780

(22) Filed: Oct. 18, 2024

(51) Int. Cl.
*B21D 19/04* (2006.01)
*B21D 43/00* (2006.01)

(52) U.S. Cl.
CPC ..... *B21D 19/046* (2013.01); *B21D 43/006* (2013.01)

(58) Field of Classification Search
CPC .... B21D 19/04; B21D 19/046; B21D 43/006; B29C 53/086; B29C 57/00
See application file for complete search history.

(56) References Cited

U.S. PATENT DOCUMENTS

| | | | | |
|---|---|---|---|---|
| 4,802,567 | A * | 2/1989 | Ikeda | B21D 43/12 269/58 |
| 6,241,229 | B1 * | 6/2001 | Bundschu | B23Q 3/00 267/71 |
| 2011/0011701 | A1 * | 1/2011 | Okimoto | B21D 43/006 198/345.1 |

FOREIGN PATENT DOCUMENTS

| | | | |
|---|---|---|---|
| CN | 201353580 | Y | 12/2009 |
| CN | 107825049 | A | 3/2018 |
| CN | 108672672 | A | 10/2018 |
| CN | 109093023 | A | 12/2018 |
| CN | 110744014 | A | 2/2020 |
| CN | 219598383 | U | 8/2023 |

(Continued)

OTHER PUBLICATIONS

OA1 of priority document of CN202410581234.3.
English Translation of OA1 of priority document of CN202410581234.3.

*Primary Examiner* — Teresa M Ekiert
(74) *Attorney, Agent, or Firm* — Whitestone Law, PLLC

(57) ABSTRACT

Processing device for flange includes processing table. Feeding and discharging conveying rollers are separately arranged on two sides of processing table, which includes bottom frame. Fixing table is fixedly arranged on middle part of bottom frame. Front side of bottom frame is provided with sliding base, and back side is provided with driving frame. Driving frame is rotationally provided with vertical driving roller. Rotation frame is rotationally arranged on upper end of driving frame and slidably provided with upper-side moving frame. Upper-side moving frame is provided with liftable lifting table, lower end of which is rotationally provided with upper-side driven roller. Inner-supporting clamping mechanism is arranged inside upper-side driven roller; and lower end thereof is provided with lower-side driven roller that can slide horizontally. Butting mechanism is arranged between upper-side and lower-side driven rollers, and clutch mechanism is arranged between rotation frame and driving roller.

10 Claims, 14 Drawing Sheets

(56) References Cited

FOREIGN PATENT DOCUMENTS

| | | | |
|---|---|---|---|
| CN | 116765191 | A | 9/2023 |
| CN | 117162074 | A | 12/2023 |
| CN | 117381611 | A | 1/2024 |
| CN | 117697430 | A | 3/2024 |
| JP | 2004017105 | A | 1/2004 |
| JP | 3816937 | B1 | 8/2006 |
| JP | 2018035907 | A | 3/2018 |
| JP | 2019076936 | A | 5/2019 |

* cited by examiner

PROCESSING DEVICE FOR FLANGE

CROSS-REFERENCE TO RELATED APPLICATION

The present disclosure claims priority to Chinese patent application No. 202410581234.3 filed with the China National Intellectual Property Administration on May 11, 2024, entitled "PROCESSING DEVICE FOR FLANGE", the entire contents of which are incorporated herein by reference.

TECHNICAL FIELD

The present disclosure belongs to the technical field of flange processing, and specifically relates to a processing device for a flange.

BACKGROUND ART

The large-sized flanges are generally processed by a ring rolling machine device. The blank used for the processing of the ring rolling machine is processed by thousands of tons of press machine, and then it is continuously rolled by the ring rolling machine to form the appearance and size close to the real flange, and then processed subsequently. Such production line is very expensive and the energy consumption is also large.

The flange with real appearance and size can be cast directly by the centrifugal casting method. This method has a small processing allowance and the manufacturing is relatively simple, but it has a large residual stress and an uneven distribution. Therefore, it needs an economical and convenient method to eliminate the residual stress of the flange cast by the centrifugal cast method.

SUMMARY

In order to overcome deficiencies in the prior art, the present disclosure provides a processing device for a flange, which solves the problem of large residual stress in the flange cast by the current centrifugal casting method.

In order to realize the above purpose, the present disclosure is realized by the following technical solutions.

A processing device for the flange includes a processing table, wherein a feeding conveying roller and a discharging conveying roller are separately arranged on two sides of the processing table, wherein the processing table includes a bottom frame; a fixing table is fixedly arranged on a middle part of the bottom frame; and the fixing table is provided with a down-pressing roller, wherein the bottom frame on one side of the fixing table is slidably provided with a sliding base, and the sliding base is provided with an up-pressing roller by a down-pressing oil cylinder; and the bottom frame on the other side of the fixing table is fixedly provided with a driving frame, and the driving frame is rotationally provided with a vertical driving roller, wherein a rotation frame is rotationally arranged on an upper end of the driving frame; the rotation frame is slidably provided with an upper-side moving frame; and the upper-side moving frame is provided with a liftable lifting table, wherein a lower end of the lifting table is rotationally provided with an upper-side driven roller, and an inner-supporting clamping mechanism is arranged inside the upper-side driven roller; and a lower end of the upper-side driven roller is provided with a lower-side driven roller that can slide horizontally, wherein a butting mechanism is arranged between the upper-side driven roller and the lower-side driven roller, wherein a clutch mechanism is arranged between the rotation frame and the driving roller, wherein when the clutch mechanism is locked, the driving roller drives the rotation frame to rotate synchronously, and when the clutch mechanism is unlocked, the rotation frame remains stationary when the driving roller rotates.

Further, the sliding base is an L-shaped platy structure including a horizontal section and a vertical section, wherein an upper-side avoidance groove is arranged on a middle part of a back-end surface of the horizontal section, and a front edge of the horizontal section is fixedly connected to an upper edge of the vertical section, wherein lower ends of left and right side surfaces of the vertical section are fixedly provided with one first sliding block respectively, and left and right ends of an upper-end surface of the bottom frame are provided with one first sliding groove respectively, wherein two first sliding blocks are slidably inserted into interiors of two first sliding grooves, wherein a fixing plate is fixedly arranged on a front edge of the upper-end surface of the bottom frame, and a sliding oil cylinder is arranged between the fixing plate and the sliding base.

Further, three vertical down-pressing oil cylinders are fixedly arranged at a lower-end surface of the horizontal section of the sliding base, and piston rods of the down-pressing oil cylinders are vertically downward; ends of the piston rods of three down-pressing oil cylinders are fixedly provided with one horizontal annular up-pressing roller base, and a back end of the up-pressing roller base is provided with an upper-side passing groove communicated inside and outside; an interior of an upper-side mounting groove at a lower-end surface of the up-pressing roller base is rotationally provided with a circle of circularly arrayed up-pressing rollers; an upper-end surface of the fixing table is fixedly provided with one horizontal annular down-pressing roller base, and a back end of the down-pressing roller base is provided with a lower-side passing groove communicated inside and outside; and an interior of a lower-side mounting groove at an upper-end surface of the down-pressing roller base is rotationally provided with a circle of circularly arrayed down-pressing rollers.

Further, a lower end of the driving frame is fixedly provided with a driving motor and a speed reducer, and an output shaft of the driving motor is connected to an input shaft of the speed reducer, wherein the output shaft of the speed reducer is vertically upward, and the output shaft of the speed reducer is fixedly connected to a lower end of a rotary shaft of the driving roller; a middle part of a front-end surface of the driving frame is provided with a semi-circular arc accommodation slot, and the driving roller rotates inside the accommodation slot, wherein a horizontal fixed mounting plate is fixedly arranged on an upper end of an interior of the accommodation slot; the fixed mounting plate is provided with a mounting hole penetrating up and down; and the rotary shaft of the driving roller passes through the mounting hole upward and rotationally connects to the interior of the mounting hole by a bearing, wherein a circular arc T-shaped groove is arranged on an upper-end surface of the driving frame, and T-shaped groove is arranged around an axis of the driving roller; and a T-shaped block is fixedly arranged on a lower end of the rotation frame, and the T-shaped block is slidably arranged inside the T-shaped groove.

Further, a front-end surface of the rotation frame is a circular arc surface, and the circular arc surface of the front end of the rotation frame is flush to a circular arc inner wall of the accommodation slot; a horizontal rotating mounting plate is fixedly arranged at an upper edge of the front-end surface of the rotation frame, and the clutch mechanism is arranged between the rotating mounting plate and the fixed mounting plate, wherein the clutch mechanism includes a lower-side clutching column, an upper-side clutching column, a driving rod, a clutching spring, a shifting fork, a sliding sleeve, a clutching oil cylinder, a hinge base, a snapping block, an upper-side snapping groove, and a lower-side snapping groove, wherein upper end of the rotary shaft of the driving roller is fixedly provided with a lower-side clutching column; the lower-side clutching column is a cylindrical structure opening at an upper end; an upper-end surface of the lower-side clutching column is fixedly provided with three circularly arrayed lower-side clutching blocks; a lower-end surface of the rotating mounting plate is fixedly provided with a vertical driving rod; and the driving rod and the driving roller are arranged coaxially, wherein an outside cylindrical surface of the driving rod is fixedly provided with a vertical second sliding groove, wherein an annular sliding sleeve is slidably sleeved on an outer side of a lower end of the driving rod; an inner wall of the sliding sleeve is fixedly provided with a second sliding block; and the second sliding block is slidably inserted into an interior of the second sliding groove.

Further, the upper-side clutching column is fixedly arranged at a lower-end surface of the sliding sleeve, and the upper-side clutching column is a cylindrical structure opening at a lower end, wherein a lower-end surface of the upper-side clutching column is fixedly provided with three circularly arrayed upper-side clutching blocks; inner and outer diameters of the upper-side clutching column are the same as inner and outer diameters of the lower-side clutching column, and a size of the upper-side clutching block is the same as a size of the lower-side clutching block; and the upper-side clutching column can slide down to completely embed into the lower-side clutching column, at which time the lower-side clutching column can drive the upper-side clutching column to rotate synchronously, wherein a clutching spring is sleeved on an outer side of the driving rod, and upper and lower ends of the clutching spring are in slidable contact with a lower-end surface of the rotating mounting plate and an upper-end surface of the sliding sleeve respectively, wherein a middle part of an outside cylindrical surface of the sliding sleeve is provided with an annular sliding groove; one sliding block is slidably inserted within interiors of left and right sides of the sliding groove respectively; and one side of each sliding block away from the sliding sleeve is rotationally provided with a square third sliding block.

Further, the shifting fork is arranged between the sliding sleeve and a front-end surface of the rotation frame, and the shifting fork includes a U-shaped segment and a linear segment, wherein one end of the linear segment is fixedly connected to a middle part of the U-shaped segment, and the other end of the linear segment extends to the front-end surface of the rotation frame; and two ends of the U-shaped segment are separately located on outer sides of two sliding blocks, and one third sliding groove is separately arranged at two ends of the U-shaped segment, wherein third sliding blocks on two sliding blocks are slidably arranged within interiors of two third sliding grooves respectively, wherein a hinge hole is arranged in a middle part of the linear segment; a hinge base is fixedly arranged at a lower-end surface of the rotating mounting plate; and the hinge hole in the middle part of the linear segment is rotationally connected to the hinge base by a pin, wherein a fourth sliding groove is arranged at one end of the linear segment close to the sliding sleeve, and a clutching oil cylinder is fixedly arranged on an upper end of the rotating mounting plate, wherein a cylinder body of the clutching oil cylinder is fixed at an upper-end surface of the rotating mounting plate; a piston rod of the clutching oil cylinder vertically passes downward through the rotating mounting plate; and a lower end of the piston rod of the clutching oil cylinder is fixedly provided with a left-right horizontal fourth sliding rod, wherein the fourth sliding rod is slidably inserted into an interior of the fourth sliding groove, wherein a vertical upper-side snapping groove is arranged in a lower end of a middle part of a front-end surface of the rotation frame; a vertical lower-side snapping groove is arranged in an upper end of a middle part of the accommodation slot of the driving frame; and both the upper-side snapping groove and the lower-side snapping groove are trapezoidal grooves with wider interiors and narrower exteriors, wherein a snapping block is slidably arranged inside a junction of the lower-side snapping groove and the upper-side snapping groove; a concave groove is arranged in an outer side surface of the snapping block; a left-right horizontal fifth sliding rod is fixedly arranged inside the groove; and one end of the linear segment of the shifting fork away from the sliding sleeve is provided with a fifth sliding groove, wherein the fifth sliding rod is slidably inserted into an interior of the fifth sliding groove.

Further, the upper-side moving frame is slidably arranged on the rotation frame along a front-back direction, and the upper-side moving frame includes an upper-side action rod, two left-right symmetrical upper-side moving rods, and a U-shaped frame, wherein two upper-side moving rods are slidably inserted into an interior of the rotation frame along a front-back horizontal direction; the upper-side action rod is fixedly arranged between back ends of two upper-side moving rods; and the U-shaped frame is a U-shaped structure opening downward, and two lower ends of the U-shaped frame are fixedly connected to front ends of two upper-side moving rods respectively, wherein an upper-side pressing oil cylinder is arranged between a back-end surface of the rotation frame and the upper-side action rod, wherein a lifting table is slidably arranged within an interior of the U-shaped frame; a vertical lifting oil cylinder is arranged between a top surface inside the U-shaped frame and the lifting table; an upper-side bearing base is fixedly arranged on a lower-end surface of the lifting table; and the upper-side driven roller is rotationally arranged with in an interior of the upper-side bearing base.

Further, the inner-supporting clamping mechanism includes an inner-supporting plate, a connecting rod, an inner-supporting oil cylinder, a sliding column, a telescopic rod, and a fixing cylinder, wherein four circularly arrayed square grooves are arranged in a lower-side region of a side wall of the upper-side driven roller; one inner-supporting plate is separately arranged in an interior of each square groove; one fixing cylinder is fixedly arranged at an internal axis of the upper-side driven roller; and outer sides of upper and lower ends of the fixing cylinder are separately fixedly connected to an inner wall of the upper-side driven roller by one fixing ring, wherein four circularly arrayed passing grooves are arranged on a side wall of the fixing cylinder, and four passing grooves are corresponding to four inner-supporting plates; and a vertical sliding column is slidably arranged in an interior of the fixing cylinder, and two connecting rods parallel above and below are arranged both between an outer side surface of the sliding column and each inner-supporting plate, wherein one end of the connecting rod is hinged to an outside cylindrical surface of the sliding column, and the other end of the connecting rod is hinged to an inner side surface of the inner-supporting plate after passing through the corresponding passing groove, wherein an inner-supporting oil cylinder is fixedly arranged on an upper-end surface of the lifting table; the cylinder body of the inner-supporting oil cylinder is fixed to the upper-end surface of the lifting table; and the piston rod of the inner-supporting oil cylinder vertically passes downward through the upper-side bearing base and then extends into an interior of the upper-side driven roller, wherein a linkage sleeve is fixedly arranged on a lower end of the piston rod of the inner-supporting oil cylinder; the linkage sleeve is a cylindrical structure opening at a lower end; and an inner wall of the linkage sleeve is provided with an annular linkage groove, wherein a linkage ring is fixedly arranged on an upper end of an outside cylindrical surface of the sliding column; the linkage ring is slidably snapped to an interior of the linkage groove; and a lower end of the fixing cylinder is fixedly provided with four telescopic rods, wherein four telescopic rods are all arranged along a radial direction of the fixing cylinder; telescopic ends of four telescopic rods are separately fixedly connected to inner side surfaces of four inner-supporting plates; and fixing ends of the four telescopic rods are fixedly connected to the lower end of the fixing cylinder.

Further, the fixing table is a block structure in a shape of a Chinese character "凹", wherein a middle part of a back-end surface of the fixing table is provided with a square lower-side avoidance groove; a lower-side moving frame is slidably arranged in an interior of the lower-side avoidance groove of the fixing table along the front-back direction; and the lower-side moving frame includes a lower-side action rod, two left-right symmetrical lower-side moving rod, and a lower-side moving base, wherein two lower-side moving rods are both slidably inserted into an interior of the driving frame along the front-back horizontal direction; the lower-side action rod is fixedly arranged between back ends of two lower-side moving rods; and the lower-side moving base is fixedly arranged between front ends of two upper-side moving rods, wherein a lower-side pressing oil cylinder is arranged between the driving frame and the lower-side action rod of the lower-side moving frame; a lower-side bearing base is fixedly arranged on an upper end of the lower-side moving base; the lower-side driven roller is rotationally arranged in an interior of the lower-side bearing base; and the butting mechanism is arranged between a lower end of the upper-side driven roller and an upper end of the lower-side driven roller, wherein the butting mechanism includes an upper-side butting column and a lower-side butting column, wherein the upper-side butting column is fixedly arranged in an interior of a lower end of the upper-side driven roller; the upper-side butting column is a cylindrical structure opening at the lower end; and the lower end of the upper-side butting column is provided with two centrally symmetrical spiral grooves, wherein the lower-side butting column is fixedly arranged in an interior of an upper end of the lower-side driven roller; the lower-side butting column is a cylindrical structure opening at an upper end; and the upper end of the lower-side butting column is provided with two centrally symmetrical spiral grooves, wherein when the upper-side driven roller butts with the lower-side driven roller, two spiral grooves of the upper-side butting column are embedded into two spiral grooves of the lower-side butting column, and the lower end of the upper-side driven roller is in contact with the upper end of the lower-side driven roller.

Compared to the prior art, the present disclosure includes the following beneficial effects.

(1) The present disclosure provides a processing device for the flange, wherein regarding flange workpiece cast by the centrifugal casting method, the flange workpiece is repeatedly bent by the up-pressing roller and down-pressing roller staggered up and down by using the principle of "straightening". The flange workpiece is repeatedly shaped and deformed, so that the residual stress of the steel-cast flange workpiece is released, and at the same time the flatness of the ring-shaped flange workpiece is improved. Meanwhile, it has the function of forging, which improves mechanical properties of the flange workpiece, such as improving the strength, hardness, and toughness of materials, so as to refine the grain of the flange workpiece, such that the internal deficiencies are eliminated, and the uniformity and density of the materials are improved, so as to improve the mechanical properties of the flange workpiece, thereby meeting the requirements of the mechanical properties and crystal phase of the flange for forge piece.

(2) The present disclosure provides a processing device for the flange, wherein the clamping device used for feeding material and discharging material is integrated to the processing device. In this way, the processing device can not only carry out a stress eliminating process on the flange workpiece, but also clamp and feed material for the workpiece in an inner-supporting method before the stress is eliminated. After the stress eliminating process is completed, it can further clamp and discharge the workpiece undergone the stressing eliminating process in an inner-supporting method, so that it does not need to be additionally provided with the clamping device, so that the occupied area of the overall device is smaller, which can be applied to the production place with the smaller area.

(3) The present disclosure provides a processing device for the flange, wherein the rotation frame can rotate by the clutch mechanism, so that the additional rotating power source does not need to be provided; and the workpiece can extend in or extend out by the upper-side pressing oil cylinder, so that the additional moving mechanism does not need to be provided, which can save more arrangement space.

BRIEF DESCRIPTION OF DRAWINGS

The present disclosure is further described in detail below in conjunction with the drawings.

REFERENCE NUMBERS

1—processing table; 2—feeding conveying roller; 3—discharging conveying roller; 4—bottom frame; 5—fixing table; 6—lower-side avoidance groove; 7—sliding base; 8—first sliding block; 9—first sliding groove; 10—fixing plate; 11—sliding oil cylinder, 12—down-pressing oil cylinder; 13—up-pressing roller base; 14—up-pressing roller; 15—down-pressing roller base; 16—down-pressing roller; 17—driving frame; 18—driving motor; 19—driving roller, 20—accommodation slot; 21—fixed mounting plate; 22—rotation frame; 23—T-shaped groove; 24—T-shaped block, 25—rotating mounting plate; 26—clutch mechanism; 27—lower-side clutching column; 28—lower-side clutching block; 29—driving rod; 30—second sliding groove; 31—sliding sleeve, 32—upper-side clutching column; 33—upper-side clutching block; 34—clutching spring; 35—sliding block; 36—third sliding block; 37—shifting fork; 38—third sliding groove; 39—hinge base; 40—fourth sliding groove; 41—clutching oil cylinder; 42—fourth sliding rod; 43—upper-side snapping groove; 44—lower-side snapping groove; 45—snapping block; 46—fifth sliding groove; 47—upper-side housing; 48—lower-side housing; 49—upper-side moving frame; 50—upper-side action rod; 51—upper-side moving rod; 52—U-shaped frame; 53—upper-side pressing oil cylinder; 54—lifting table; 55—sixth sliding block; 56—sixth sliding groove; 57—lifting oil cylinder; 58—upper-side bearing base; 59—upper-side driven roller; 60—inner-supporting clamping mechanism; 61—inner-supporting plate; 62—fixing cylinder; 63—passing groove; 64—sliding column; 65—connecting rod; 66—inner-supporting oil cylinder; 67—linkage sleeve; 68—linkage ring; 69—telescopic rod; 70—lower-side moving frame; 71—lower-side action rod; 72—lower-side moving rod; 73—lower-side moving base; 74—lower-side pressing oil cylinder; 75—lower-side bearing base; 76—lower-side driven roller; 77—upper-side butting column; 78—lower-side butting column; and 79—spiral groove.

DETAILED DESCRIPTION OF EMBODIMENTS

In order to make technical problems to be solved, technical solutions, and beneficial effects of the present disclosure clearer and more understandable, the present disclosure will be further described in detail in conjunction with the embodiments and the drawings. It should be understood that the specific embodiments described herein are used only to explain the present disclosure and are not intended to limit the present disclosure. The technical solutions of the present disclosure are described in detail below in conjunction with the embodiments and the drawings, but the scope of protection is not limited by this.

Figure 1:
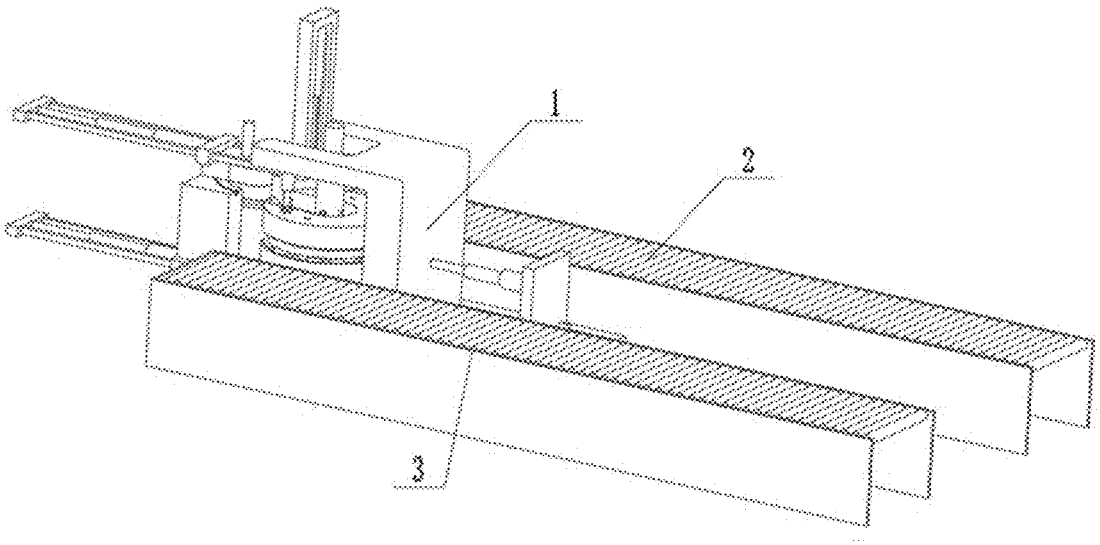
FIG. 1 is a three-dimensional schematic diagram of the entire present disclosure.
Figure 2:
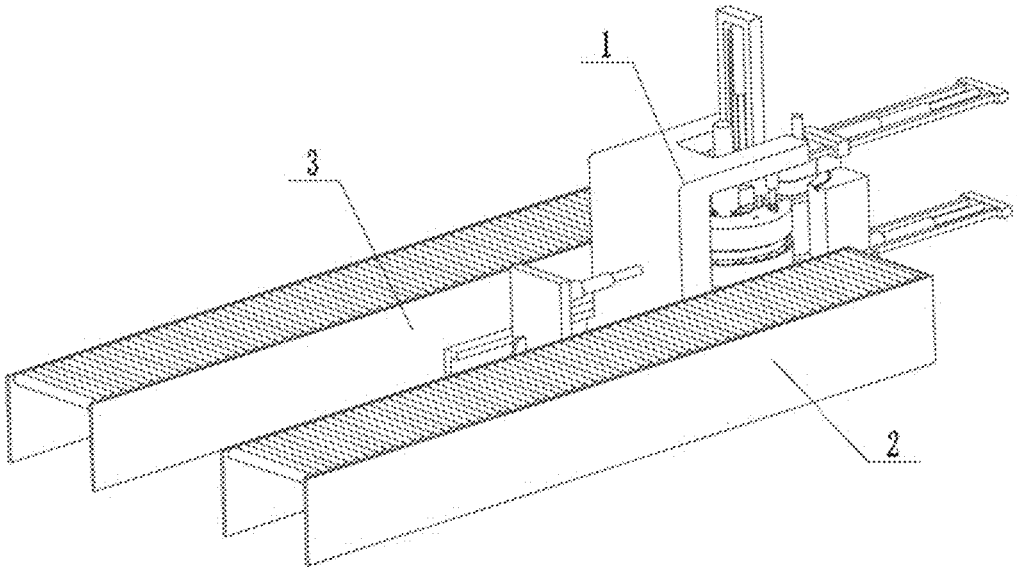
FIG. 2 is another three-dimensional schematic diagram of the entire present disclosure.
Figure 3:
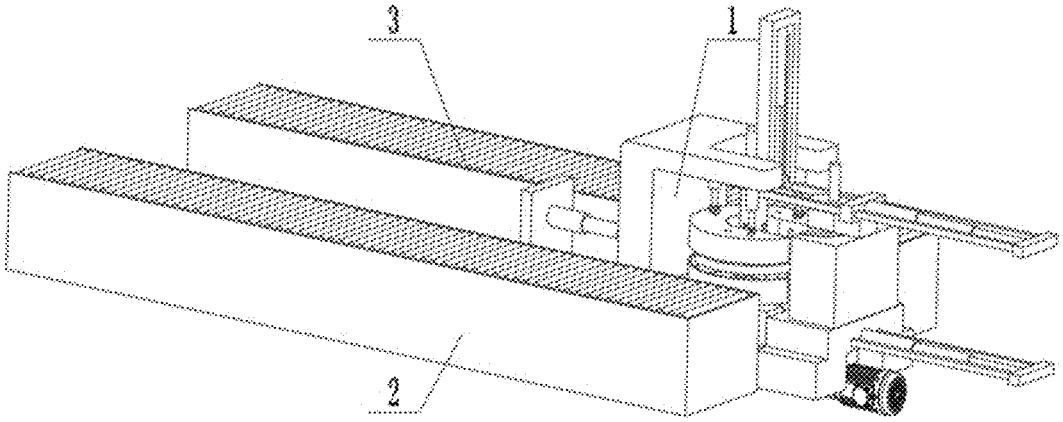
FIG. 3 is another three-dimensional schematic diagram of the entire present disclosure.
Figure 4:
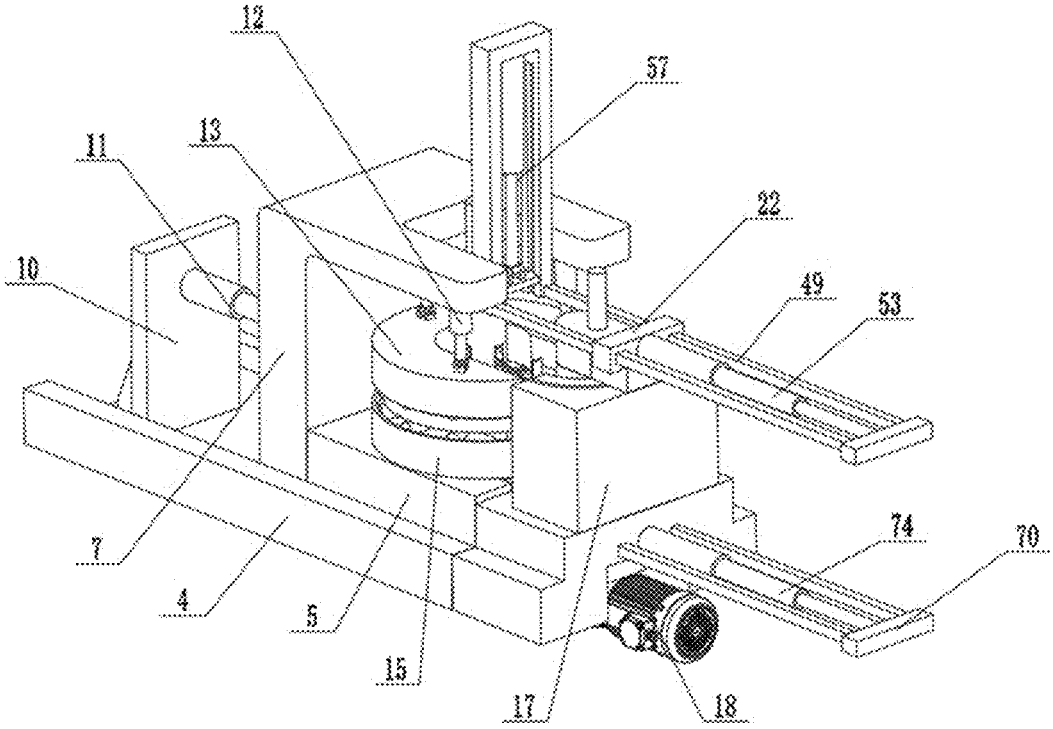
FIG. 4 is a three-dimensional schematic diagram of a processing table.
Figure 5:
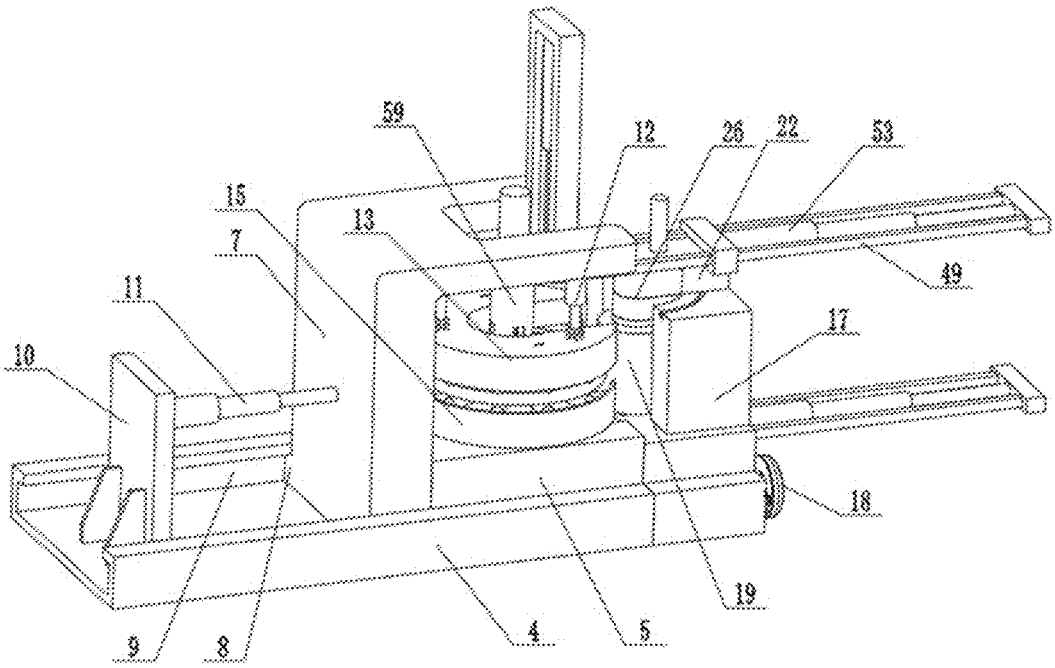
FIG. 5 is the other three-dimensional schematic diagram of a processing table.
Figure 6:
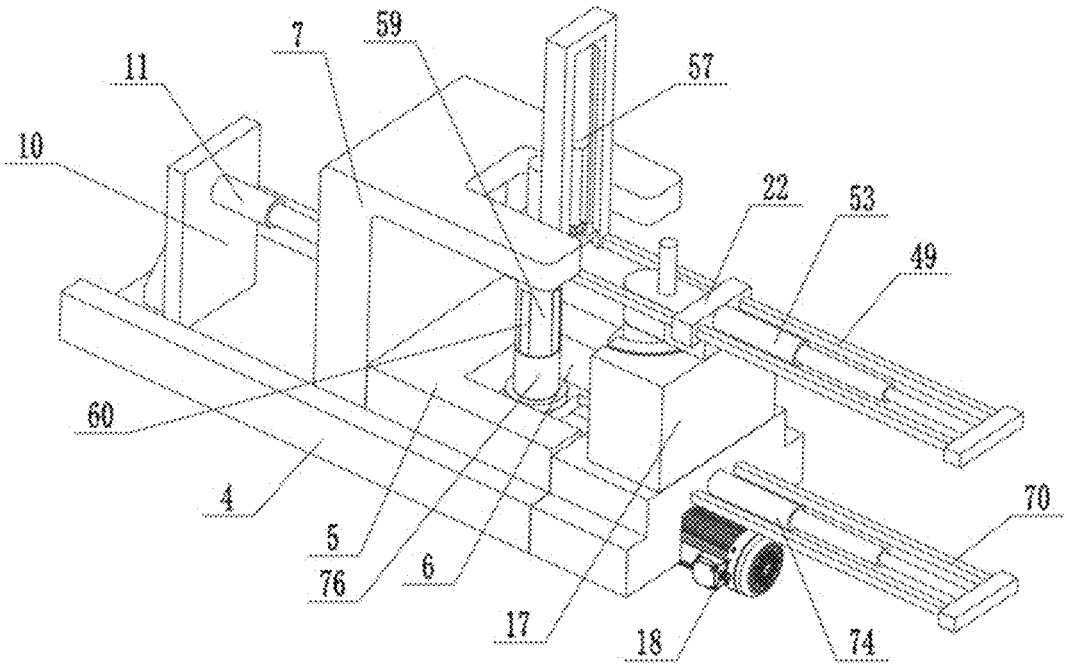
FIG. 6 is a three-dimensional schematic diagram of a processing table after removing a down-pressing oil cylinder, an up-pressing roller base, and a down-pressing roller base.
Figure 7:
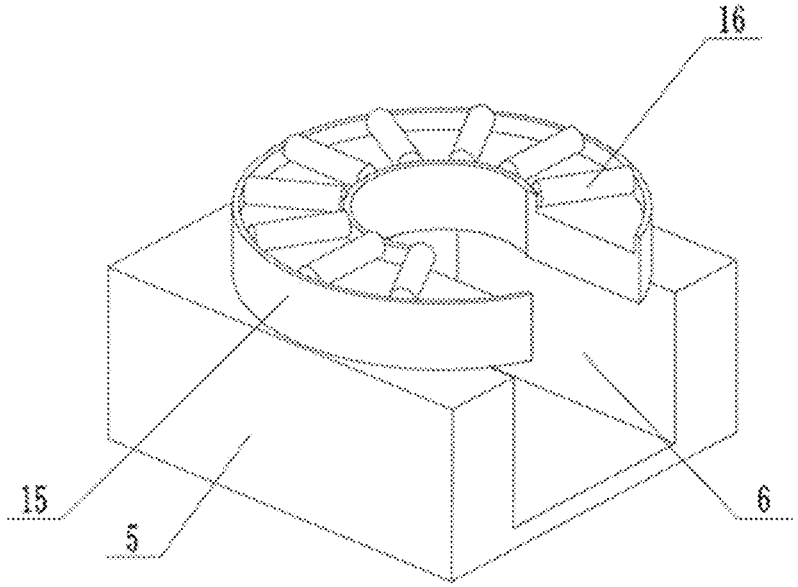
FIG. 7 is a structure schematic diagram of a fixing table and a down-pressing roller base.
Figure 8:
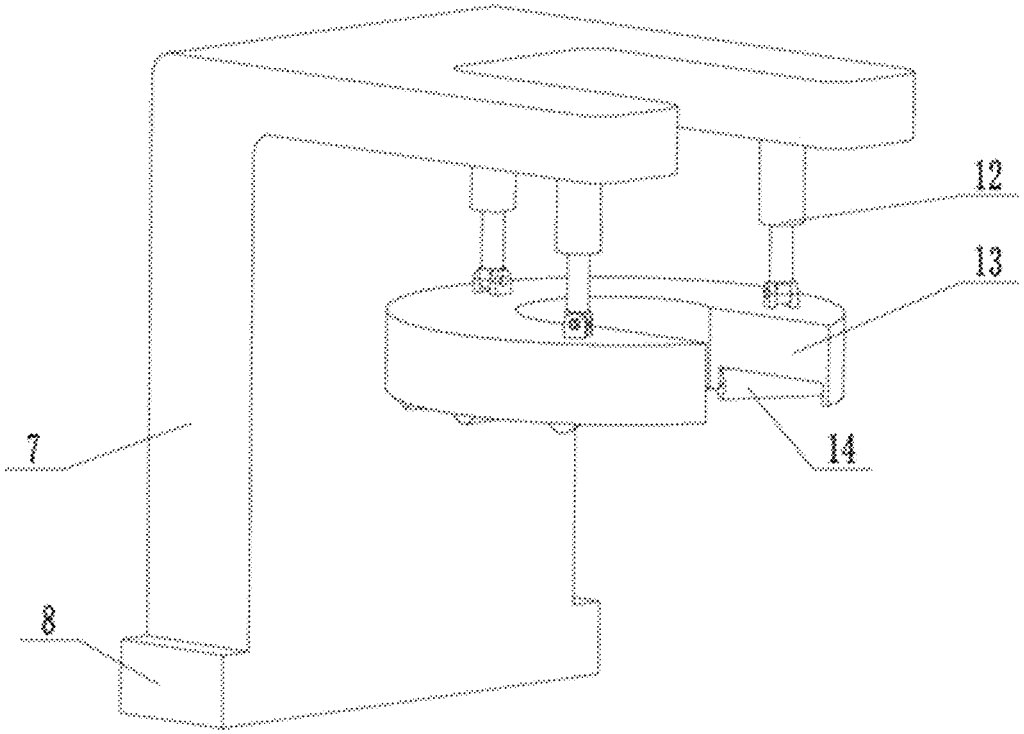
FIG. 8 is a structure schematic diagram of a sliding base, a down-pressing oil cylinder, and an up-pressing roller base.
Figure 9:
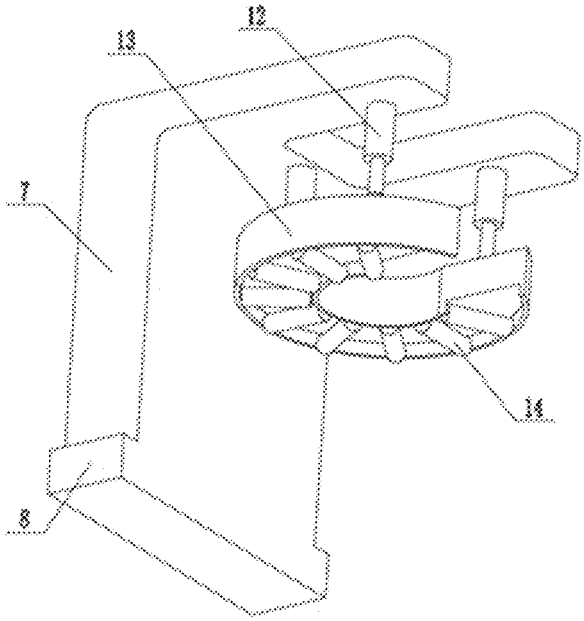
FIG. 9 is the other structure schematic diagram of a sliding base, a down-pressing oil cylinder; and an up-pressing roller base.
Figure 10:
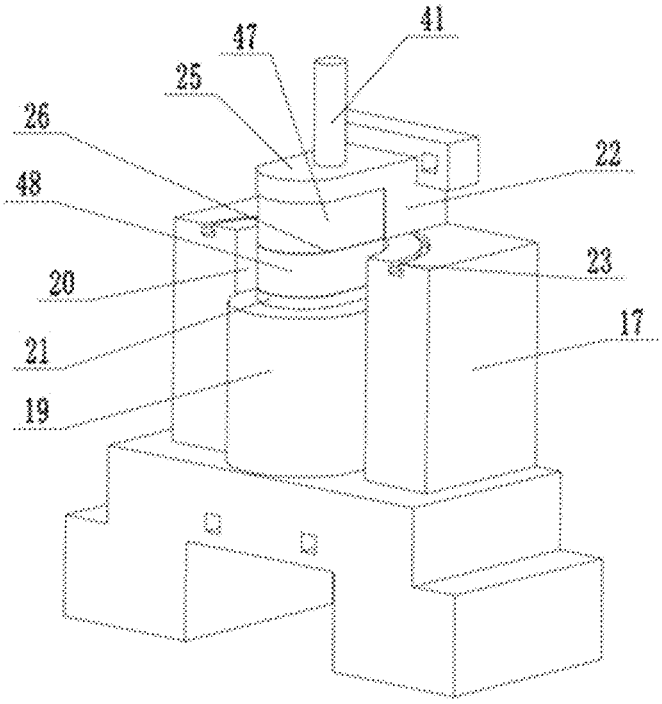
FIG. 10 is a connection schematic diagram of a driving frame and a rotation frame.
Figure 11:
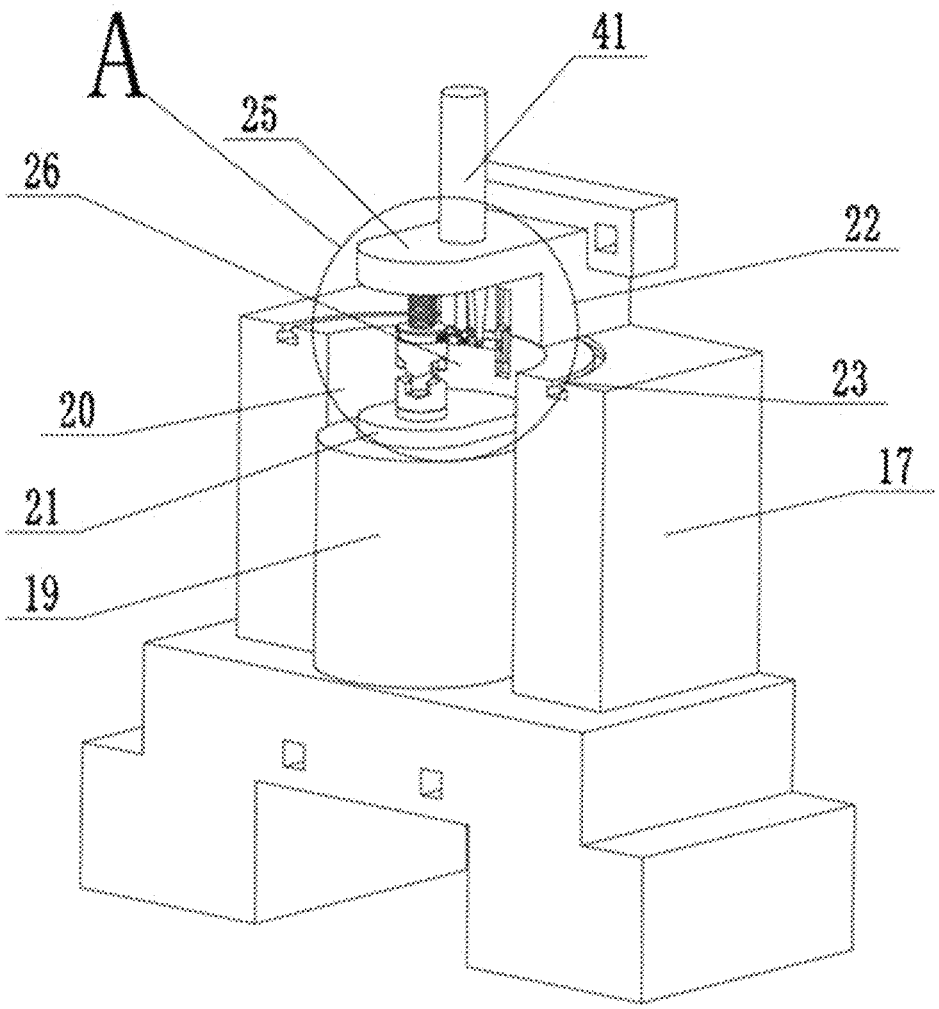
FIG. 11 is the other connection schematic diagram of a driving frame and a rotation frame.
Figure 12:
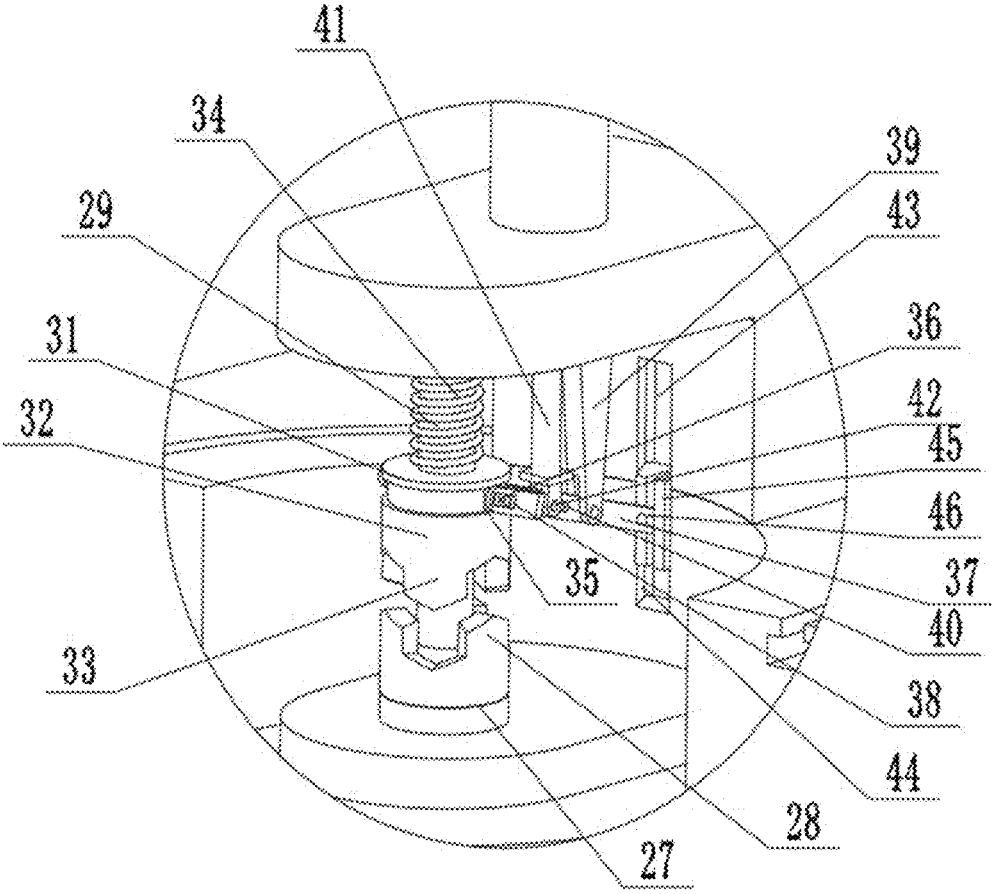
FIG. 12 is a local enlarged schematic diagram at A in FIG. 11.
Figure 13:
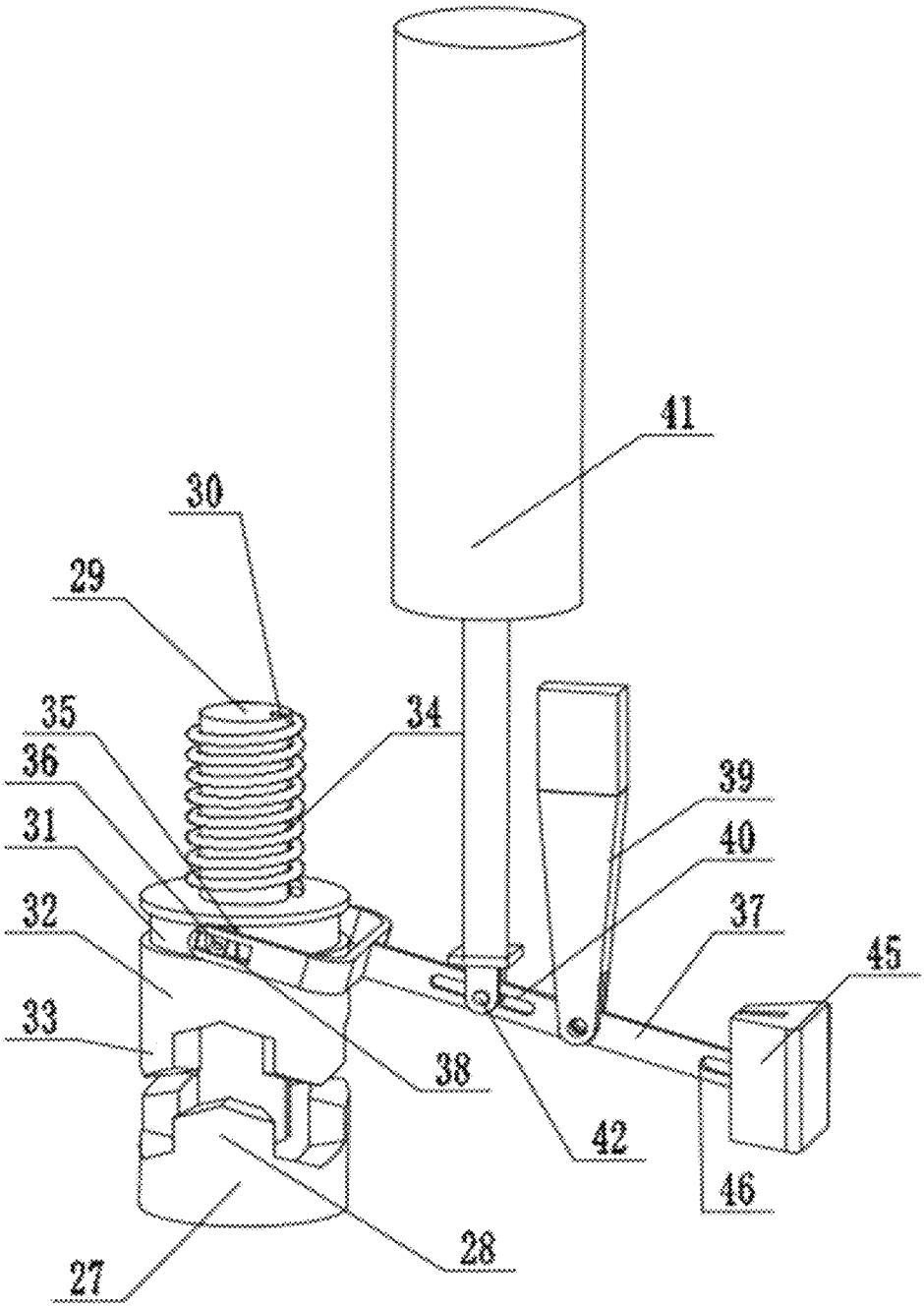
FIG. 13 is a local structure schematic diagram of a clutch structure.
Figure 14:
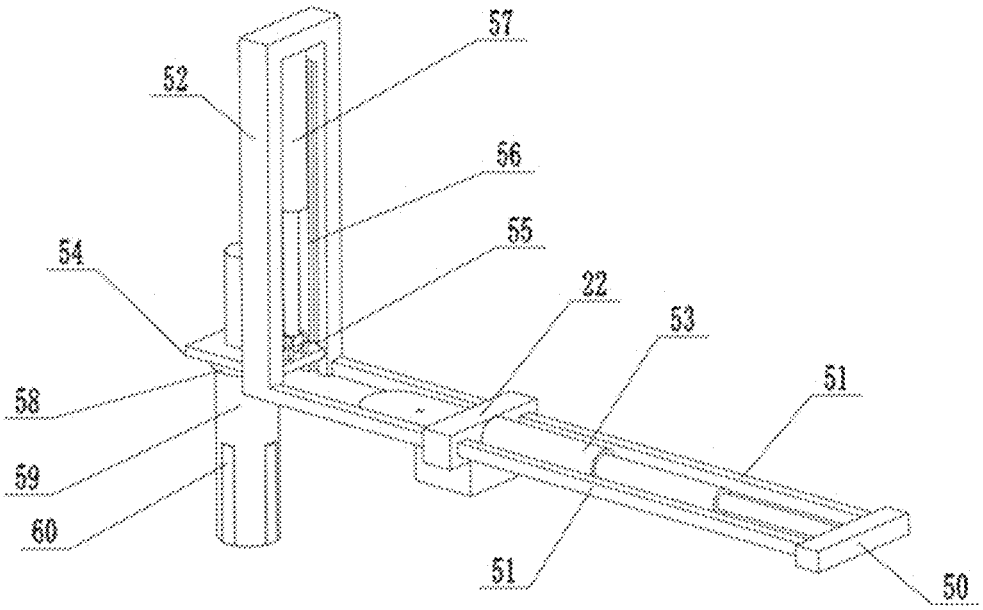
FIG. 14 is a connection schematic diagram of an upper-side moving frame and an upper-side driven roller.
Figure 15:
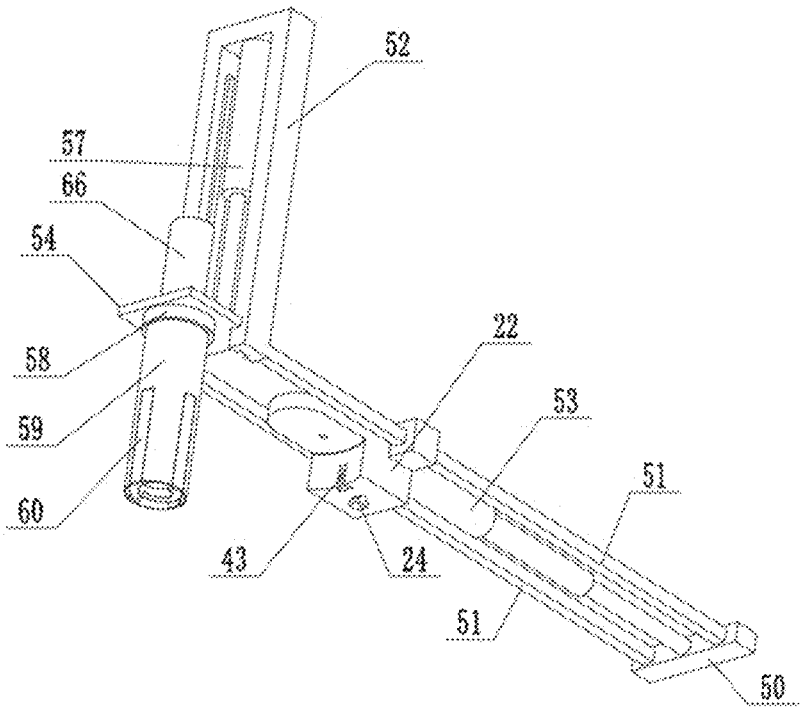
FIG. 15 is the other connection schematic diagram of an upper-side moving frame and an upper-side driven roller.
Figure 16:
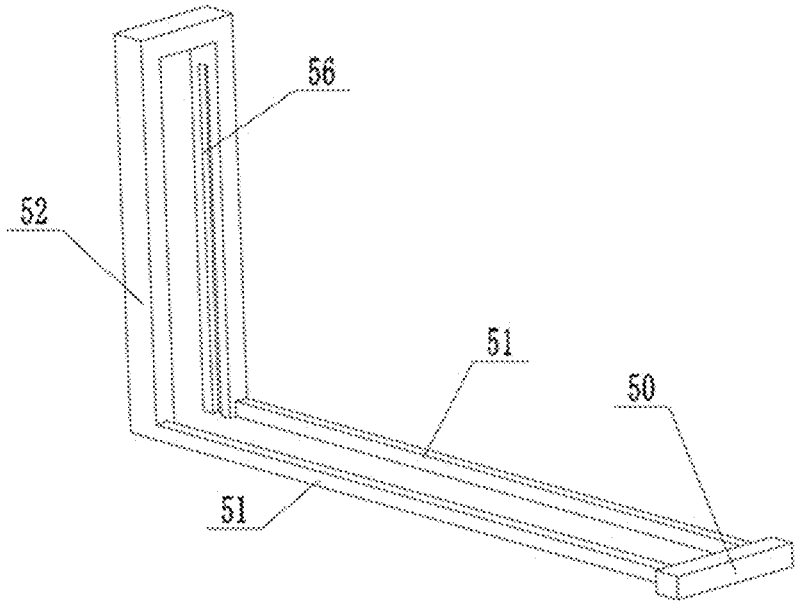
FIG. 16 is a structure schematic diagram of an upper-side moving frame.
Figure 17:
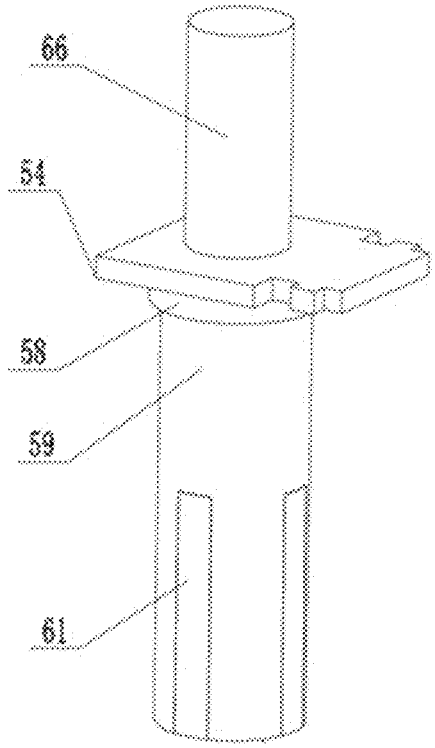
FIG. 17 is a structure schematic diagram of an inner-supporting clamping mechanism in a contracted state.
Figure 18:
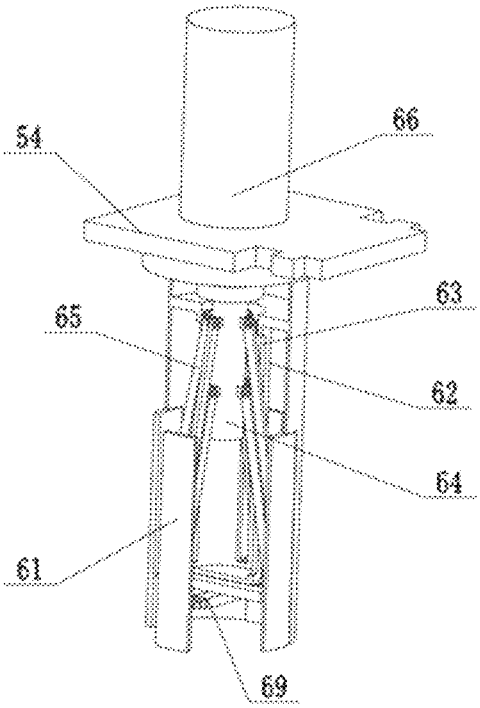
FIG. 18 is a structure schematic diagram of an upper-side driven roller of FIG. 17 in a semi-sectional state.
Figure 19:
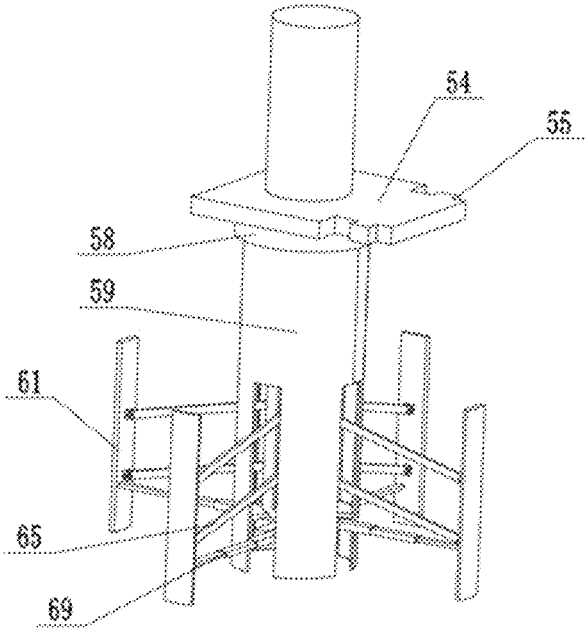
FIG. 19 is a structure schematic diagram of an inner-supporting clamping mechanism in an unfolded state.
Figure 20:
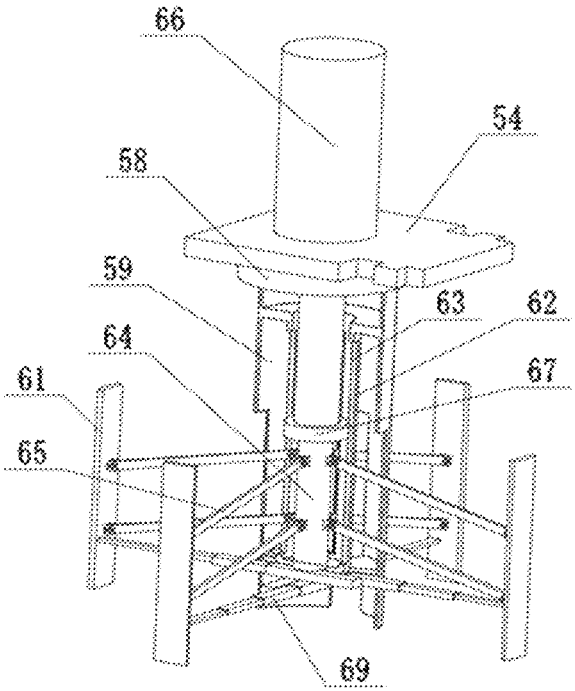
FIG. 20 is a structure schematic diagram of an upper-side driven roller of FIG. 19 in a semi-sectional state.
Figure 21:
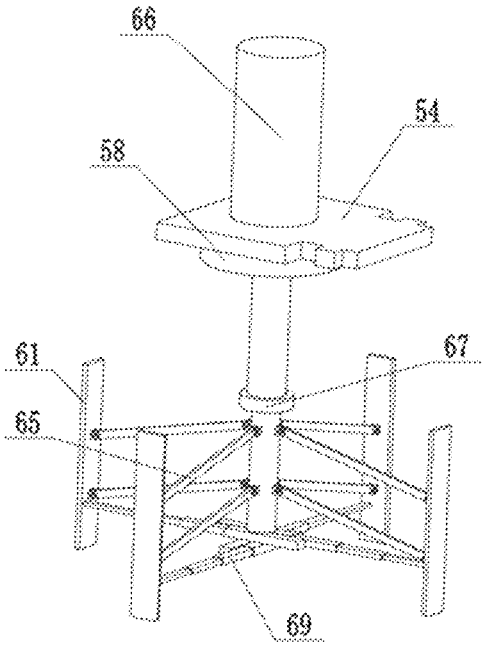
FIG. 21 is a structure schematic diagram of FIG. 19 removing an upper-side driven roller.
Figure 22:
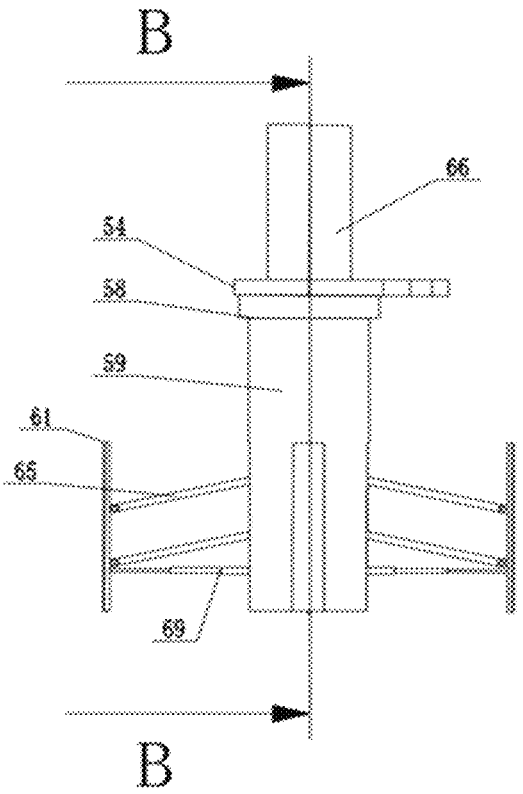
FIG. 22 is a front view of FIG. 19.
Figure 23:
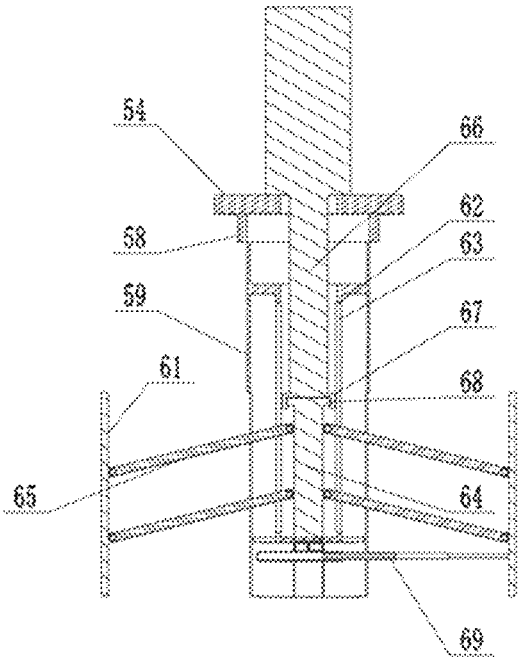
FIG. 23 is a sectional view at B-B of FIG. 22.
Figure 24:
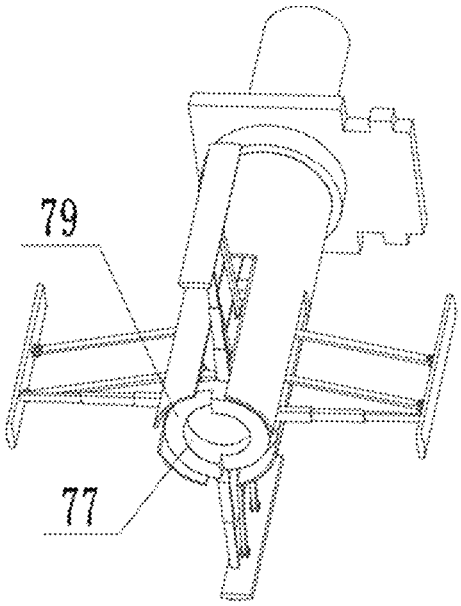
FIG. 24 is a structure schematic diagram of an upper-side butting column.
Figure 25:
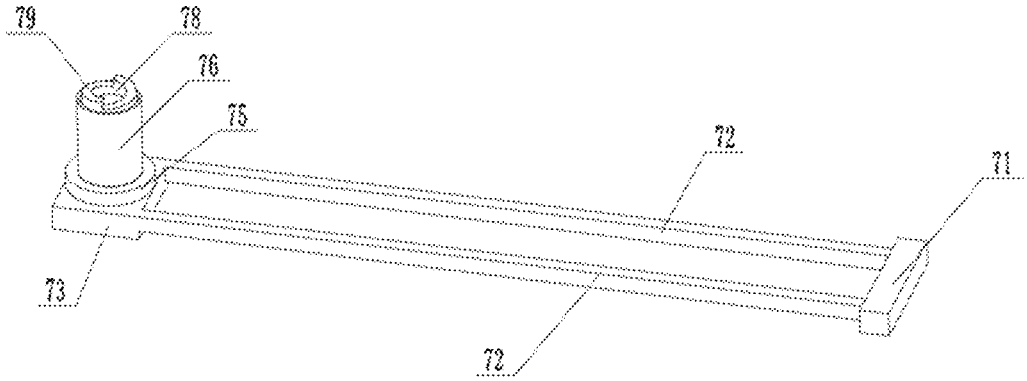
FIG. 25 is a structure schematic diagram of a lower-side moving frame.

As shown in FIG. 1-FIG. 25, the present disclosure provides a processing device for the flange including a processing table 1, wherein a feeding conveying roller 2 and a discharging conveying roller 3 are separately arranged on two sides of the processing table 1, wherein the processing table 1 includes a bottom frame 4; a fixing table 5 is fixedly arranged on a middle part of the bottom frame 4; and the fixing table 5 is provided with a down-pressing roller 16, wherein the bottom frame 4 on one side of the fixing table 5 is slidably provided with a sliding base 7, and the sliding base 7 is provided with an up-pressing roller 14 by a down-pressing oil cylinder 12; and the bottom frame 4 on the other side of the fixing table 5 is fixedly provided with a driving frame 17, and the driving frame 17 is rotationally provided with a vertical driving roller 19, wherein a rotation frame 22 is rotationally arranged on an upper end of the driving frame 17; the rotation frame 22 is slidably provided with an upper-side moving frame 49; and the upper-side moving frame 49 is provided with a liftable lifting table 54, wherein a lower end of the lifting table 54 is rotationally provided with an upper-side driven roller 59, and an inner-supporting clamping mechanism 60 is arranged inside the upper-side driven roller 59; and a lower end of the upper-side driven roller 59 is provided with a lower-side driven roller 76 that can slide horizontally, wherein a butting mechanism is arranged between the upper-side driven roller 59 and the lower-side driven roller 76, wherein a clutch mechanism 26 is arranged between the rotation frame 22 and the driving roller 19, wherein when the clutch mechanism 26 is locked, the driving roller 19 drives the rotation frame 22 to rotate synchronously, and when the clutch mechanism 26 is unlocked, the rotation frame 22 remains stationary when the driving roller 19 rotates.

The bottom frame 4 is arranged horizontally in a front-back direction, and the fixing table 5 is fixedly arranged on a middle part of the upper-end surface of the bottom frame 4. The fixing table 5 is of a block structure in a shape of a Chinese character "凹", wherein a middle part of a back-end surface of the fixing table 5 is provided with a square lower-side avoidance groove 6, and the lower-side avoidance groove 6 is communicated with the upper-end surface of the fixing table 5.

The sliding base 7 is fixedly arranged on an upper end of the bottom frame 4 on a front side of the fixing table 5. The sliding base 7 is an L-shaped platy structure including a horizontal section and a vertical section, wherein the horizontal section is a horizontally arranged platy structure in a shape of a Chinese character "凹"; an upper-side avoidance groove communicated up and down is arranged on a middle part of a back-end surface of the horizontal section; the vertical section is a square platy structure located in left and right vertical planes; and a front edge of the horizontal section is fixedly connected to an upper edge of the vertical section. The lower ends of left and right side surfaces of the vertical section are fixedly provided with one first sliding block 8 respectively, and left and right ends of an upper-end surface of the bottom frame 4 are provided with one first sliding groove 9 respectively, wherein the first sliding groove 9 extends horizontally in the front-back direction, and two first sliding blocks 8 are slidably inserted into interiors of two first sliding grooves 9, so that the sliding base 7 can slide forward and backward on the upper end of the bottom frame 4, and at the same time the sliding base 7 will not slip out of the bottom frame 4.

A vertical fixing plate 10 is fixedly arranged on the front edge of the upper-end surface of the bottom frame 4, and a sliding oil cylinder 11 is fixedly arranged at the back-end surface of the fixing plate 10. One end of the bottom of the sliding oil cylinder 11 is fixedly connected to the back-end surface of the fixing plate 10, and one end of the piston rod of the sliding oil cylinder 11 extends horizontally backward and is connected to the front-end surface of the vertical section of the sliding base 7, wherein the sliding base 7 is controlled to slide back and forth on the upper end of the bottom frame 4 by the expansion and contraction of the sliding oil cylinder 11.

Three vertical down-pressing oil cylinders 12 are fixedly arranged at the lower-end surface of the horizontal section of the sliding base 7, wherein the bottoms of the down-pressing oil cylinders 12 are fixedly connected to the lower-end surface of the horizontal section of the sliding base 7, and the piston rods of the down-pressing oil cylinders 12 are vertically downward. The ends of the piston rods of three down-pressing oil cylinders 12 are fixedly provided with one horizontal annular up-pressing roller base 13, wherein a back end of the up-pressing roller base 13 is provided with an upper-side passing groove communicated inside and outside, and the upper-side passing groove is located below the upper-side avoidance groove. The lower-end surface of the up-pressing roller base 13 is provided with a circular arc upper-side mounting groove, and a circle of circularly arrayed up-pressing rollers 14 are rotationally arranged inside the upper-side mounting groove, wherein rotary shafts of the up-pressing rollers 14 are arranged along the radial direction of the up-pressing roller base 13; the rotary shafts of the up-pressing rollers 14 are rotationally arranged on the inner walls of two sides of the upper-side mounting groove respectively; and a lowest point of the up-pressing rollers 14 is located at the outer side of the lower-end opening of the upper-side mounting groove. The sliding base 7 lifts up and lays down the up-pressing roller base 13 by the down-pressing oil cylinder 12. When the sliding base 7 slides back and forth, the up-pressing roller base 13 is driven to slide back and forth synchronously.

The upper-end surface of the fixing table 5 is fixedly provided with one horizontal annular down-pressing roller base 15, and a back end of the down-pressing roller base 15 is provided with a lower-side passing groove communicated inside and outside. The upper-end surface of the down-pressing roller base 15 is provided with a circular arc lower-side mounting groove, and a circle of circularly arrayed down-pressing rollers 16 are rotationally arranged inside the lower-side mounting groove, wherein rotary shafts of the down-pressing rollers 16 are arranged along the radial direction of the down-pressing roller base 15; the rotary shafts of the down-pressing rollers 16 are rotationally arranged on the inner walls of two sides of the lower-side mounting groove respectively; and a highest point of the down-pressing rollers 16 is located at an outer side of the opening of the upper end of the lower-side mounting groove.

A circle of down-pressing rollers 16 are staggered with a circle of up-pressing rollers 14.

The driving frame 17 is fixedly arranged on an upper end of the bottom frame 4 on a back side of the fixing table 5, and the lower end of the driving frame 17 is fixedly provided with a driving motor 18 and a speed reducer, wherein an output shaft of the driving motor 18 is connected to an input shaft of the speed reducer. The output shaft of the speed reducer is vertically upward, and the output shaft of the speed reducer is fixedly connected to a lower end of a rotary shaft of the driving roller 19, wherein the driving motor 18 drives the driving roller 19 to rotate by the speed reducer.

The middle part of a front-end surface of the driving frame 17 is provided with a semi-circular arc accommodation slot 20, and the driving roller 19 rotates inside the accommodation slot 20. A horizontal fixed mounting plate 21 is fixedly arranged on an upper end of an interior of the accommodation slot 20; the fixed mounting plate 21 is provided with a mounting hole penetrating up and down; and the rotary shaft of the driving roller 19 passes through the mounting hole upward and rotationally connects to the interior of the mounting hole by a bearing.

The rotation frame 22 is slidably arranged on the upper end of the driving frame 17; a circular arc T-shaped groove 23 is arranged in the upper-end surface of the driving frame 17; the T-shaped groove 23 is arranged around an axis of the driving roller 19; a T-shaped block 24 is fixedly arranged on the lower end of the rotation frame 22; and the T-shaped block 24 is slidably arranged inside the T-shaped groove 23, wherein the rotation of the rotation frame 22 on the upper end of the driving frame 17 is realized by the sliding of the T-shaped block 24 inside the T-shaped groove 23.

The front-end surface of the rotation frame 22 is a circular arc surface, and the circular arc surface of the front end of the rotation frame 22 is flush to a circular arc inner wall of the accommodation slot 20. A horizontal rotating mounting plate 25 is fixedly arranged at an upper edge of the front-end surface of the rotation frame 22, and the clutch mechanism 26 is arranged between the rotating mounting plate 25 and the fixed mounting plate 21. The clutch mechanism 26 includes a lower-side clutching column 27, an upper-side clutching column 32, a driving rod 29, a clutching spring 34, a shifting fork 37, a sliding sleeve 31, a clutching oil cylinder 41, a hinge base 39, a snapping block 45, an upper-side snapping groove 43, and a lower-side snapping groove 44.

The upper end of the rotary shaft of the driving roller 19 is fixedly provided with a lower-side clutching column 27, wherein the lower-side clutching column 27 is a cylindrical structure opening at an upper end, and an upper-end surface of the lower-side clutching column 27 is fixedly provided with three circularly arrayed lower-side clutching blocks 28. The angle at the circumference of the upper-end surface corresponding to each lower-side clutching block 28 is 60°; the inner side surface and outer side surface of the lower-side clutching block 28 are both flush to the inner side surface and outer side surface of the lower-side clutching column 27; the upper-end surface of each lower-side clutching block 28 is a convex "⌒" shaped beveled surface; and the inner bottom surface of the region between any two neighboring lower-side clutching blocks 28 is a concave "⌣" shaped beveled surface.

The lower-end surface of the rotating mounting plate 25 is fixedly provided with a vertical driving rod 29, wherein the driving rod 29 and the driving roller 19 are coaxially arranged; the driving rod 29 is located above the rotary shaft of the driving roller 19; and an outside cylindrical surface of the driving rod 29 is fixedly provided with a vertical second sliding groove 30. An annular sliding sleeve 31 is slidably sleeved on an outer side of a lower end of the driving rod 29, and an inner wall of the sliding sleeve 31 is fixedly provided with a second sliding block, wherein the second sliding block is slidably inserted into an interior of the second sliding groove 30, so that the sliding sleeve 31 can slide relative to the driving rod 29 and cannot rotate relative to the driving rod 29, i.e., the sliding sleeve 31 drives the driving rod 29 to rotate synchronously when rotating.

The upper-side clutching column 32 is fixedly arranged at a lower-end surface of the sliding sleeve 31, and the upper-side clutching column 32 is a cylindrical structure opening at a lower end, wherein a lower-end surface of the upper-side clutching column 32 is fixedly provided with three circularly arrayed upper-side clutching blocks 33; the angle at the circumference of the lower-end surface corresponding to each upper-side clutching block 33 is 60°; the inner side surface and outer side surface of the upper-side clutching block 33 are both flush to the inner side surface and outer side surface of the upper-side clutching column 32; the lower-end surface of each upper-side clutching block 33 is a convex "⌣" shaped beveled surface; and the inner top surface of the region between any two neighboring upper-side clutching blocks 33 is a concave "⌒" shaped beveled surface.

The inner and outer diameters of the upper-side clutching column 32 are the same as inner and outer diameters of the lower-side clutching column 27, and the size of the upper-side clutching block 33 is the same as the size of the lower-side clutching block 28. The upper-side clutching column 32 can slide down to completely embed into the lower-side clutching column 27, at which time the lower-side clutching column 27 can drive the upper-side clutching column 32 to rotate synchronously.

A clutching spring 34 is sleeved on an outer side of the driving rod 29, wherein upper and lower ends of the clutching spring 34 are in slidable contact with the lower-end surface of the rotating mounting plate 25 and the upper-end surface of the sliding sleeve 31 respectively.

The middle part of an outside cylindrical surface of the sliding sleeve 31 is provided with an annular sliding groove; one sliding block 35 is slidably inserted within interiors of left and right sides of the sliding groove respectively; and the sliding block 35 is in sliding contact with a top surface, bottom surface, and inside circular surface of the sliding groove. One side of each sliding block 35 away from the sliding sleeve 31 is rotationally provided with a square third sliding block 36.

The shifting fork 37 is arranged between the sliding sleeve 31 and the front-end surface of the rotation frame 22, and the shifting fork includes 37 a U-shaped segment and a linear segment, wherein one end of the linear segment is fixedly connected to the middle part of the U-shaped segment, and the other end of the linear segment extends to the front-end surface of the rotation frame 22. Two ends of the U-shaped segment are separately located on outer sides of two sliding blocks 35, and one third sliding groove 38 is separately arranged at two ends of the U-shaped segment, wherein third sliding blocks 36 on two sliding blocks 35 are slidably arranged within interiors of two third sliding grooves 38 respectively. A hinge hole is arranged in the middle part of the linear segment; a hinge base 39 is fixedly arranged at the lower-end surface of the rotating mounting plate 25; and the hinge hole in the middle part of the linear segment is rotationally connected to the hinge base 39 by a pin. A fourth sliding groove 40 is arranged at one end of the linear segment close to the sliding sleeve 31, and a clutching oil cylinder 41 is fixedly arranged on the upper end of the rotating mounting plate 25, wherein a cylinder body of the clutching oil cylinder 41 is fixed at the upper-end surface of the rotating mounting plate 25; a piston rod of the clutching oil cylinder 41 vertically passes downward through the rotating mounting plate 25; and a lower end of the piston rod of the clutching oil cylinder 41 is fixedly provided with a left-right horizontal fourth sliding rod 42 by two lug plates, wherein the fourth sliding rod 42 is slidably inserted into the interior of the fourth sliding groove 40, and the outside cylindrical surface of the fourth sliding rod 42 is in sliding contact with inner walls of two sides of the fourth sliding groove 40.

A vertical upper-side snapping groove 43 is arranged in the lower end of the middle part of the front-end surface of the rotation frame 22; a vertical lower-side snapping groove 44 is arranged in the upper end of the middle part of the accommodation slot 20 of the driving frame 17; and both the upper-side snapping groove 43 and the lower-side snapping groove 44 are trapezoidal grooves with wider interiors and narrower exteriors. A snapping block 45 is slidably arranged inside a junction of the lower-side snapping groove 44 and the upper-side snapping groove 43; a concave groove is arranged in an outer side surface of the snapping block 45; a left-right horizontal fifth sliding rod is fixedly arranged inside the groove; and one end of the linear segment of the shifting fork 37 away from the sliding sleeve 31 is provided with a fifth sliding groove 46, wherein the fifth sliding rod is slidably inserted into an interior of the fifth sliding groove 46, and the outside cylindrical surface of the fifth sliding rod is in sliding contact with inner walls of two sides of the fifth sliding groove 46.

The lower-end surface of the rotating mounting plate 25 is fixedly provided with a detachable upper-side housing 47, wherein the lower end of the upper-side housing 47 keeps open and is flush to the lower-end surface of the rotation frame 22. The upper-end surface of the fixed mounting plate 21 is fixedly provided with a detachable lower-side housing 48, wherein the upper end of the lower-side housing 48 keeps open and is flush to the upper-end surface of the driving frame 17. The upper-side housing 47 and the lower-side housing 48 are covered on an outer side of the clutch mechanism 26, and the clutch mechanism 26 is protected by the upper-side housing 47 and the lower-side housing 48.

When the clutching oil cylinder 41 is in a contracted state, one end of the shifting fork 37 close to the sliding sleeve 31 is in a high position, and one end of the shifting fork 37 away from the sliding sleeve 31 is in a low position, i.e., the sliding sleeve 31 is in the high position, and the snapping block 45 is in the low position. The sliding sleeve 31 drives the upper-side clutching column 32 to be in the high position; the upper-side clutching column 32 is detached from the lower-side clutching column 27; and the clutching spring 34 is in a compressed state. The snapping block 45 is located in the interior of the junction between the upper-side snapping groove 43 and the lower-side snapping groove 44 at this time, and the driving frame 17 and the rotation frame 22 cannot rotate relative to each other due to the limitation of the snapping block 45, i.e., the rotation frame 22 is limited to a default position. The driving motor 18 drives the driving roller 19 to rotate by the speed reducer at this time, and the lower-side clutching column 27 does not drive the upper-side clutching column 32 to rotate due to the detachment of the upper-side clutching column 32 from the lower-side clutching column 27.

When the piston rod of the clutching oil cylinder 41 gradually extends, one end of the shifting fork 37 close to the sliding sleeve 31 is driven to decline gradually, and at the same time, one end of the shifting fork 37 away from the sliding sleeve 31 gradually rises. The shifting fork 37 drives the sliding sleeve 31 to slide downwardly on the driving rod 29 by two sliding blocks 35 until the upper-side clutching column 32 is embedded into the lower-side clutching column 27, and the shifting fork 37 drives snapping block 45 to slide upwardly until it completely enters the interior of the upper-side snapping groove 43. Since the snapping block 45 is detached from the lower-side snapping groove 44, the rotation frame 22 and the driving frame 17 can rotate relative to each other. The lower-side clutching column 27 drives the upper-side clutching column 32 to rotate at this time, and the upper-side clutching column 32 drives the sliding sleeve 31 to rotate. Since the second sliding block inside the sliding sleeve 31 is slidably inserted into an interior of the second sliding groove 30 on the driving rod 29, the sliding sleeve 31 drives the driving rod 29 to rotate, and the driving rod 29 drives the rotation frame 22 to rotate around the axis of the driving roller 19. When the rotation frame 22 rotates, the T-shaped block 24 at the lower end rotates inside the T-shaped groove 23 on the upper end of the driving frame 17, so as to ensure that the rotation frame 22 will not detach from the driving frame 17.

The upper-side moving frame 49 is slidably arranged on the rotation frame 22 along the front-back direction, and the upper-side moving frame 49 includes an upper-side action rod 50, two left-right symmetrical upper-side moving rods 51, and a U-shaped frame 52. Two upper-side moving rods 51 are slidably inserted into an interior of the rotation frame 22 along the front-back horizontal direction, and the upper-side action rod 50 is fixedly arranged between back ends of two upper-side moving rods 51. The U-shaped frame 52 is a U-shaped rod structure opening downward, and two lower ends of the U-shaped frame 52 are fixedly connected to front ends of two upper-side moving rods 51 respectively.

An upper-side pressing oil cylinder 53 is arranged between the back-end surface of the rotation frame 22 and the upper-side action rod 50, wherein one end of the bottom of the upper-side pressing oil cylinder 53 is fixedly connected to the back-end surface of the rotation frame 22, and one end of the piston rod of the upper-side pressing oil cylinder 53 is horizontally backward and is fixedly connected to the upper-side action rod 50, wherein the sliding of the upper-side moving frame 49 on the rotation frame 22 is controlled by the expansion and contraction of the upper-side pressing oil cylinder 53.

A lifting table 54 is slidably arranged within an interior of the U-shaped frame 52, and the lifting table 54 is a horizontally arranged platy structure. One sixth sliding block 55 is fixedly arranged on left and right sides of the lifting table 54 respectively, and one vertical sixth sliding groove 56 is arranged on inner walls of two sides of the U-shaped frame 52, wherein two sixth sliding blocks 55 are slidably inserted into the interior of the sixth sliding groove 56 at the same side respectively. A vertical lifting oil cylinder 57 is arranged inside the U-shaped frame 52, wherein one end of the bottom of the lifting oil cylinder 57 is fixedly connected to the internal top surface of the U-shaped frame 52, and one end of the piston rod of the lifting oil cylinder 57 is vertically downward and is fixedly connected to the upper end of the lifting table 54, wherein the lifting and lowering of the lifting table 54 inside the U-shaped frame 52 of the upper-side moving frame 49 are controlled by the extension and contradiction of the lifting oil cylinder 57.

An upper-side bearing base 58 is fixedly arranged on the lower-end surface of the lifting table 54, and the upper-side driven roller 59 is rotationally arranged within an interior of the upper-side bearing base 58, wherein the upper-side driven roller 59 is a vertically arranged cylindrical structure opening at upper and lower ends, and the upper end of the upper-side driven roller 59 is rotationally arranged inside the upper-side bearing base 58.

The inner-supporting clamping mechanism 60 includes an inner-supporting plate 61, a connecting rod 65, an inner-supporting oil cylinder 66, a sliding column 64, a telescopic rod 69, and a fixing cylinder 62.

Four circularly arrayed square grooves are arranged in a lower-side region of a side wall of the upper-side driven roller 59, and the square grooves are communicated with the lower end of the upper-side driven roller 59. One inner-supporting plate 61 is separately arranged in an interior of each square groove, and the outside circular arc surface of the inner-supporting plate 61 coincides with the outside cylindrical surface of the upper-side driven roller 59.

One fixing cylinder 62 is fixedly arranged at an internal axis of the upper-side driven roller 59, and the fixing cylinder 62 is a vertical cylindrical structure opening at upper and lower ends. The outer sides of upper and lower ends of the fixing cylinder 62 are separately fixedly connected to the inner wall of the upper-side driven roller 59 by one fixing ring. Four circularly arrayed passing grooves 63 are arranged on the side wall of the fixing cylinder 62, and four passing grooves 63 are corresponding to four inner-supporting plates 61. A vertical sliding column 64 is slidably arranged in an interior of the fixing cylinder 62, and two connecting rods 65 parallel above and below are arranged both between an outer side surface of the sliding column 64 and each inner-supporting plate 61, wherein one end of the connecting rod 65 is hinged to an outside cylindrical surface of the sliding column 64, and the other end of the connecting rod 65 is hinged to an inner side surface of the inner-supporting plate 61 after passing through the corresponding passing groove 63.

An inner-supporting oil cylinder 66 is fixedly arranged on an upper-end surface of the lifting table 54; the cylinder body of the inner-supporting oil cylinder 66 is fixed to the upper-end surface of the lifting table 54; and the piston rod of the inner-supporting oil cylinder 66 vertically passes downward through the upper-side bearing base 58 and then extends into an interior of the upper-side driven roller 59. A linkage sleeve 67 is fixedly arranged on a lower end of the piston rod of the inner-supporting oil cylinder 66; the linkage sleeve 67 is a cylindrical structure opening at a lower end; and an inner wall of the linkage sleeve 67 is provided with an annular linkage groove. A linkage ring 68 is fixedly arranged on an upper end of an outside cylindrical surface of the sliding column 64, wherein the linkage ring 68 is slidably snapped to an interior of the linkage groove, and upper and lower ends of the linkage ring 68 are in sliding contact with the top surface and bottom surface of the linkage groove respectively. The sliding column 64 can be driven to lift and lower by the inner-supporting oil cylinder 66 through the cooperation between the linkage sleeve 67 and the linkage ring 68, and at the same time, the sliding column 64 can also rotate relative to the linkage sleeve 67.

The lower end of the fixing cylinder 62 is fixedly provided with four telescopic rods 69, wherein two telescopic rods 69 are distributed on each side of the upper and lower sides respectively. Four telescopic rods 69 are all arranged along a radial direction of the fixing cylinder 62, and telescopic ends of four telescopic rods 69 are separately fixedly connected to inner side surfaces of four inner-supporting plates 61, wherein the fixing end of two upper-side telescopic rods 69 on the upper side is fixedly connected to the lower end of the fixing cylinder 62, and the fixing end of two telescopic rods 69 at the lower side is fixedly connected to the fixing end of two telescopic rods 69 on the upper side. Four telescopic poles 69 are all multistage telescopic rods. By providing four telescopic rods 69, four inner-supporting plates 61 can extend outwardly or retract inwardly in the horizontal direction.

A lower-side moving frame 70 is slidably arranged in an interior of the lower-side avoidance groove 6 of the fixing table 5 along a front-back direction; and the lower-side moving frame 70 includes a lower-side action rod 71, two left-right symmetrical lower-side moving rod 72, and a lower-side moving base 73, wherein two lower-side moving rods 72 are both slidably inserted into an interior of the driving frame 17 along the front-back horizontal direction; the lower-side action rod 71 is fixedly arranged between back ends of two lower-side moving rods 72; and the lower-side moving base 73 is fixedly arranged between front ends of two upper-side moving rods 51.

A lower-side pressing oil cylinder 74 is arranged between the driving frame 17 and the lower-side action rod 71; one end of the bottom of the lower-side pressing oil cylinder 74 is fixedly connected to the back-end surface of the driving frame 17; and one end of the piston rod of the lower-side pressing oil cylinder 74 is horizontally backward and is fixedly connected to the lower-side action rod 71. The forward and backward movement of the lower-side moving frame 70 is controlled by the expansion and contraction of the lower-side pressing oil cylinder 74.

A lower-side bearing base 75 is fixedly arranged on an upper end of the lower-side moving base 73, and the lower-side driven roller 76 is rotationally arranged in an interior of the lower-side bearing base 75, wherein the lower-side driven roller 76 is a cylindrical structure opening at the upper end, and the lower end of the lower-side driven roller 76 is rotationally connected to the interior of the lower-side bearing base 75.

The butting mechanism is arranged between a lower end of the upper-side driven roller 59 and an upper end of the lower-side driven roller 76, wherein the butting mechanism includes an upper-side butting column 77 and a lower-side butting column 78. The upper-side butting column 77 is fixedly arranged in an interior of the lower end of the upper-side driven roller 59; the upper-side butting column 77 is a cylindrical structure opening at the lower end; and the lower end of the upper-side butting column 77 is provided with two centrally symmetrical spiral grooves 79, wherein the spiral grooves 79 have half pitch. The lower-side butting column 78 is fixedly arranged in an interior of the upper end of the lower-side driven roller 76; the lower-side butting column 78 is a cylindrical structure opening at an upper end; and the upper end of the lower-side butting column 78 is provided with two centrally symmetrical spiral grooves 79, wherein the spiral grooves 79 have half pitch. When the upper-side driven roller 59 butts with the lower-side driven roller 76, two spiral grooves 79 of the upper-side butting column 77 are embedded into two spiral grooves 79 of the lower-side butting column 78, and the lower end of the upper-side driven roller 59 is in contact with the upper end of the lower-side driven roller 76.

The feeding conveying roller 2 and the discharging conveying roller 3 extend in the front-back direction, and back ends of the feeding conveying roller 2 and the discharging conveying roller 3 are separately arranged on the left and right sides of the fixing table 5.

The method of use of the present disclosure includes the following steps.

Step 1: before the processing device works, the sliding oil cylinder 11, the lifting oil cylinder 57, the clutching oil cylinder 41, the down-pressing oil cylinder 12, and the inner-supporting oil cylinder 66 are all in the contracted state, at which time the sliding base 7 is located at the foremost side; the lifting table 54 drives the upper-side driven roller 59 to be at the highest point; the inner-supporting clamping mechanism 60 inside the upper-side driven roller 59 is in a contracted state; and the driving frame 17 is in a locking state with the rotation frame 22.

Step 2: when the produced flange workpiece is required to undergo a stress eliminating process, the workpiece is conveyed to the back end via the feeding conveying roller 2 first; then the driving roller 19 controls to rotate by the driving motor 18 via the speed reducer; and at the same time the piston rod of the clutching oil cylinder 41 is controlled to extend out, wherein the piston rod of the clutching oil cylinder 41 drives one end of the shifting fork 37 close to the sliding sleeve 31 to gradually decline, and at the same time one end of the shifting fork 37 away from the sliding sleeve 31 gradually rises, wherein the shifting fork 37 drives the sliding sleeve 31 to slide downward on the driving rod 29 by two sliding blocks 35 until the upper-side clutching column 32 is embedded into the lower-side clutching column 27, and the shifting fork 37 drives the snapping block 45 to slide upwardly until fully entering the interior of the upper-side snapping groove 43. Since the snapping block 45 is detached from the lower-side snapping groove 44, the rotation frame 22 and the driving frame 17 can rotate relative to each other. At this time, the lower-side clutching column 27 drives the upper-side clutching column 32 to rotate, and the upper-side clutching column 32 drives the sliding sleeve 31 to rotate. Since the second sliding block inside the sliding sleeve 31 is slidably inserted into the interior of the second sliding groove 30 on the driving rod 29, the sliding sleeve 31 drives the driving rod 29 to rotate, and the driving rod 29 drives the rotation frame 22 to rotate around the axis of the driving roller 19, wherein when the rotation frame 22 rotates, the T-shaped block 24 at the lower end rotates inside the T-shaped groove 23 on the upper end of the driving frame 17, so as to ensure that the rotation frame 22 will not detach from the driving frame 17. The rotation frame 22 drives the upper-side moving frame 49, the lifting table 54, and the upper-side driven roller 59 to rotate above the axis of the workpiece as a whole, and then driving motor 18 stops rotating.

Step 3: the piston rod of the control lifting oil cylinder 57 is controlled to extend out, so that the lifting table 54 drives the upper-side driven roller 59 to move downwardly as a whole until the lower end of the upper-side driven roller 59 is inserted into the interior of the workpiece, wherein the lower end of the lower-side driven roller 76 is flush to the lower end of the workpiece; and then the piston rod of the inner-supporting oil cylinder 66 is controlled to extend out, wherein the piston rod of the inner-supporting oil cylinder 66 drives the sliding column 64 to slide downwardly through the cooperation between the linkage sleeve 67 and the linkage ring 68, so that the connecting rod 65 between the sliding column 64 and the inner-supporting plate 61 gradually opens outwardly. Four inner-supporting plates 61 gradually extend outwardly until they are in close contact with the inner wall of the workpiece, wherein the telescopic rod 69 is horizontally arranged to ensure that the inner-supporting plate 61 extends out horizontally and outwardly. Four inner-supporting plates 61 stably support the inner wall of the workpiece by the extrusion of the piston rod of the inner-supporting oil cylinder 66, so that the workpiece can be lifted upwardly by four inner-supporting plates 61.

Step 4: the piston rod of the lifting oil cylinder 57 is controlled to withdraw, and the workpiece is lifted up by four inner-supporting plates 61; and then the driving motor 18 is controlled to rotate reversely, wherein the driving motor 18 drives the rotation frame 22 to rotate reversely by the speed reducer, the driving rollers 19, and the clutch mechanism 26, and the rotation frame 22 drives the upper-side moving frame 49 to rotate reversely, wherein when the upper-side moving frame 49 drives the upper-side driven roller 59 and the workpiece to rotate as a whole to the upper part of the down-pressing roller base 15, the driving motor 18 stops rotating reversely.

Step 5: the piston rod of the control lifting oil cylinder 57 is controlled to extend out, so that the upper-side driven roller 59 drives the workpiece gradually decline until the workpiece comes into contact with the down-pressing roller 16 on the down-pressing roller base 15, at which time the axis of the workpiece coincides with the axis of the down-pressing roller base 15; and next the piston rod of the inner-supporting oil cylinder 66 is controlled to withdraw and the sliding column 64 is controlled to slide upwardly, wherein the inner-supporting plate 61 is gradually withdrawn by the connecting rod 65 until the outside circular arc surface of the inner-supporting plate 61 coincides with the outside cylindrical surface of the upper-side driven roller 59.

Step 6: the piston rod of the clutching oil cylinder 41 is controlled to withdraw, wherein the piston rod of the clutching oil cylinder 41 drives one end of the shifting fork 37 close to the sliding sleeve 31 to gradually rise, and at the same time one end of the shifting fork 37 away from the sliding sleeve 31 gradually declines, wherein the shifting fork 37 drives the sliding sleeve 31 to slide upwardly on the driving rod 29 by two sliding blocks 35 until the upper-side clutching column 32 completely detaches from the lower-side clutching column 27, wherein the clutching spring 34 is in a compressed state, and the shifting fork 37 drives the snapping block 45 to slide downward until entering the interior of the junction between the upper-side snapping groove 43 and the lower-side snapping groove 44. The driving frame 17 and the rotation frame 22 cannot rotate relative to each other due to the limitation of the snapping block 45, i.e., the rotation frame 22 is limited to the default position. At this time, since the upper-side clutching column 32 detaches from the lower-side clutching column 27, the lower-side clutching column 27 does not drive the upper-side clutching column 32 to rotate and the upper-side clutching column 32 no longer drives the rotation frame 22 to rotate even if the driving motor 18 drives the driving roller 19 to rotate by the speed reducer.

Step 6: the piston rod of the control lifting oil cylinder 57 is controlled to extend out continuously until two spiral grooves 79 of the upper-side butting column 77 are embedded into two spiral grooves 79 of the lower-side butting column 78, at which time the lower end of the upper-side driven roller 59 is in contact with the upper end of the lower-side driven roller 76, so that the upper-side driven roller 59 and the lower-side driven roller 76 can rotate synchronously in the same direction.

Step 7: the piston rod of the sliding oil cylinder 11 is controlled to extend out, so that the sliding oil cylinder 11 drives the sliding base 7 to move backward as a whole until the up-pressing roller base 13 moves above the down-pressing roller base 15 and coincides with the axis of the down-pressing roller base 15; and then the piston rod of the down-pressing oil cylinder 12 is controlled to extend out, so that the up-pressing roller base 13 gradually declines until the up-pressing rollers 14 on the up-pressing roller base 13 are all in close contact with the surface of the workpiece.

Step 8: the driving motor 18 is controlled to start rotating, and at the same time the piston rods of the upper-side pressing oil cylinder 53 and the lower-side pressing oil cylinder 74 are controlled to gradually extend, so that the upper-side moving frame 49 and the lower-side moving frame 70 synchronously move backward, and the upper-side driven roller 59 and the lower-side driven roller 76 also synchronously move backward, wherein the flange workpiece is driven to move backward together until the flange workpiece is contacted with the driving roller 19 that is rotating. The piston rods of the upper-side pressing oil cylinder 53 and the lower-side pressing oil cylinder 74 gradually extend, so that the flange workpiece is extruded by both the upper-side driven roller 59 and the driving roller 19, and at the same time, the piston rod of the down-pressing oil cylinder 12 continuously extends, so that the up-pressing roller 14 on the up-pressing roller base 13 always extrudes the upper-end surface of the workpiece, wherein the flange workpiece, the upper-side driven roller 59, and the lower-side driven roller 76 always rotate under the drive of the driving roller 19, so that the inside cylindrical surface, the outside cylindrical surface, the upper-end surface, and the lower-end surface of the flange workpiece are always in the extrusion state, so as to eliminate the residual stress inside the flange workpiece.

Step 9: the piston rod of the down-pressing oil cylinder 12 is controlled to withdraw, wherein the up-pressing roller 14 on the up-pressing roller base 13 is detached from the workpiece; the piston rod of the control sliding oil cylinder 11 is controlled to withdraw, wherein the sliding base 7 slides to the foremost side, at which time the upper part of the workpiece is in a completely open state; the piston rod of the lifting oil cylinder 57 is controlled to withdraw, so that the lower end of the lower-side driven roller 76 is flush to the lower end of the workpiece; the piston rod of the inner-supporting oil cylinder 66 is controlled to extend, so that the inner wall of the workpiece is tightly supported by four inner-supporting plates 61 again; and next the piston rod of the control lifting oil cylinder 57 is controlled to withdraw continuously, so that the lifting table 54 drives the workpiece to gradually rise via the upper-side driven roller 59, and the workpiece is detached from the down-pressing roller 16 on the down-pressing roller base 15

Step 10: the driving motor 18 controls the driving roller 19 to rotate reversely by the speed reducer, and at the same time controls the clutch mechanism 26 to unlock the rotation frame 22 from the driving frame 17, at which time the lower-side clutching column 27 drives the upper-side clutching column 32 to rotate; the upper-side clutching column 32 drives the sliding sleeve 31 to rotate; the sliding sleeve 31 drives the driving rod 29 to rotate; the driving rod 29 drives the rotation frame 22 to rotate around the axis of the driving roller 19; and the rotation frame 22 drives the upper-side moving frame 49, the lifting table 54, and the upper-side driven roller 59 as a whole to rotate above the back end of the discharging conveying roller 3, and the driving motor 18 stops rotating.

Step 11: the piston rod of the control lifting oil cylinder 57 is controlled to extend out, wherein the workpiece is placed at the back end of the discharging conveying roller 3; then the piston rod of the inner-supporting oil cylinder 66 is controlled to withdraw and the sliding column 64 is controlled to slide upwardly, wherein the inner-supporting plate 61 is gradually withdrawn by the connecting rod 65 until the outside circular arc surface of the inner-supporting plate 61 coincides with the outside cylindrical surface of the upper-side driven roller 59; and the piston rod of the lifting oil cylinder 57 is controlled to withdraw, so that the lifting table 54 and the upper-side driven roller 59 return to the initial height.

Step 12: the driving motor 18 is controlled to rotate, so that the upper-side driven roller 59 returns to the upper part of the axis of the down-pressing roller base 15 again; and the clutch mechanism 26 is controlled to lock the rotation frame 22 with the driving frame 17 again, at which time the processing device returns to the initial state and waits to process the next workpiece.

For persons skilled in the art, it is obvious that the present disclosure is not limited to the details of the above exemplary embodiments, and the present disclosure can be realized in other specific forms without departing from the spirit or basic characteristics of the present disclosure. Therefore, from any point of view, the embodiments should be viewed as exemplary and non-restrictive. The scope of the present disclosure is limited by the attached claims instead of the above description. Therefore, it is intended to include in the present disclosure the meaning of equivalent component in the claim and all changes in the scope, and any reference number in the claim should not be regarded as a limitation to the claim which relates.

The invention claimed is:

1. A processing device for a flange, comprising:
a processing table,
a feeding conveying roller;
a discharging conveying roller,
a fixing table,
a rotation frame,
an inner-supporting clamping mechanism,
a butting mechanism,
and a clutch mechanism, wherein
the feeding conveying roller and the discharging conveying roller are separately arranged on two sides of the processing table, wherein
the processing table comprises a bottom frame;
the fixing table is fixedly arranged on a middle part of the bottom frame;
and the fixing table is provided with a down-pressing roller, wherein
the bottom frame on one side of the fixing table is slidably provided with a sliding base, and the sliding base is provided with an up-pressing roller by a down-pressing oil cylinder;
and the bottom frame on the other side of the fixing table is fixedly provided with a driving frame, and the driving frame is rotationally provided with a vertical driving roller, wherein
the rotation frame is rotationally arranged on an upper end of the driving frame;
the rotation frame is slidably provided with an upper-side moving frame;
and the upper-side moving frame is provided with a liftable lifting table, wherein a lower end of the lifting table is rotationally provided with an upper-side driven roller, and the inner-supporting clamping mechanism is arranged inside the upper-side driven roller; and
a lower end of the upper-side driven roller is provided with a lower-side driven roller that can slide horizontally, wherein the butting mechanism is arranged between the upper-side driven roller and the lower-side driven roller, and the clutch mechanism is arranged between the rotation frame and the driving roller, wherein when the clutch mechanism is locked, the driving roller drives the rotation frame to rotate synchronously, and when the clutch mechanism is unlocked, the rotation frame remains stationary when the driving roller rotates.

2. The processing device for the flange according to claim 1, further comprising:
a fixing plate and a sliding oil cylinder, wherein
the sliding base is an L-shaped plate structure comprising a horizontal section and a vertical section, wherein an upper-side avoidance groove is arranged on a middle part of a back-end surface of the horizontal section, and a front edge of the horizontal section is fixedly connected to an upper edge of the vertical section, wherein lower ends of left and right side surfaces of the vertical section are fixedly provided with one first sliding block respectively, and left and right ends of an upper-end surface of the bottom frame are provided with one first sliding groove respectively, wherein two first sliding blocks are slidably inserted into interiors of two first sliding grooves, wherein the fixing plate is fixedly arranged on a front edge of the upper-end surface of the bottom frame, and the sliding oil cylinder is arranged between the fixing plate and the sliding base.

3. The processing device for the flange according to claim 2, further comprising
three vertical down-pressing oil cylinders, wherein
the three vertical down-pressing oil cylinders are fixedly arranged at a lower-end surface of the horizontal section of the sliding base, and piston rods of the down-pressing oil cylinders are vertically downward;
ends of the piston rods of the three down-pressing oil cylinders are fixedly provided with one horizontal annular up-pressing roller base, and a back end of the up-pressing roller base is provided with an upper-side passing groove communicated inside and outside; an interior of a mounting groove at a lower-end surface of the up-pressing roller base is rotationally provided with a circle of circularly arrayed up-pressing rollers;
an upper-end surface of the fixing table is fixedly provided with one horizontal annular down-pressing roller base, and a back end of the down-pressing roller base is provided with a lower-side passing groove communicated inside and outside; and
an interior of a mounting groove at an upper-end surface of the down-pressing roller base is rotationally provided with a circle of the down-pressing rollers in a circular array.

4. The processing device for the flange according to claim 1, further comprising:
one horizontal fixed mounting plate, and
a circular arc T-shaped groove, and
a T-shaped block, wherein
a lower end of the driving frame is fixedly provided with a driving motor and a speed reducer, and an output shaft of the driving motor is connected to an input shaft of the speed reducer, wherein the output shaft of the speed reducer is vertically upward, and the output shaft of the speed reducer is fixedly connected to a lower end of a rotary shaft of the driving roller;

a middle part of a front-end surface of the driving frame is provided with one semi-circular arc accommodation slot; and the driving roller rotates inside the accommodation slot, wherein the horizontal fixed mounting plate is fixedly arranged on an upper end of an interior of the accommodation slot;

the fixed mounting plate is provided with one mounting hole penetrating up and down; and the rotary shaft of the driving roller passes through the mounting hole upward and rotationally connects to an interior of the mounting hole by a bearing, wherein the circular arc T-shaped groove is arranged on an upper-end surface of the driving frame, and the T-shaped groove is arranged around an axis of the driving roller; and the T-shaped block is fixedly arranged on a lower end of the rotation frame, and the T-shaped block is slidably arranged inside the T-shaped groove.

5. The processing device for the flange according to claim 4, wherein a front-end surface of the rotation frame is a circular arc surface, and the circular arc surface of a front end of the rotation frame is flush to a circular arc inner wall of the accommodation slot; one horizontal rotating mounting plate is fixedly arranged at an upper edge of the front-end surface of the rotation frame; and the clutch mechanism is arranged between the rotating mounting plate and the fixed mounting plate.

6. The processing device for the flange according to claim 5, wherein the clutch mechanism comprises a lower-side clutching column, an upper-side clutching column, a driving rod, a clutching spring, a shifting fork, a sliding sleeve, a clutching oil cylinder, a hinge base, a snapping block, an upper-side snapping groove, a lower-side snapping groove, and one annular sliding sleeve, wherein an upper end of the rotary shaft of the driving roller is fixedly provided with the lower-side clutching column, and the lower-side clutching column is a cylindrical structure opening at an upper end, wherein an upper-end surface of the lower-side clutching column is fixedly provided with three circularly arrayed lower-side clutching blocks;

a lower-end surface of the rotating mounting plate is fixedly provided with one vertical driving rod; and the driving rod and the driving roller are arranged coaxially, wherein an outside cylindrical surface of the driving rod is fixedly provided with one vertical second sliding groove;

the annular sliding sleeve is slidably sleeved on an outer side of a lower end of the driving rod; an inner wall of the sliding sleeve is fixedly provided with a second sliding block; and the second sliding block is slidably inserted into an interior of the second sliding groove, wherein the upper-side clutching column is fixedly arranged at a lower-end surface of the sliding sleeve, and the upper-side clutching column is a cylindrical structure opening at a lower end, wherein a lower-end surface of the upper-side clutching column is fixedly provided with three circularly arrayed upper-side clutching blocks;

inner and outer diameters of the upper-side clutching column are the same as inner and outer diameters of the lower-side clutching column, and a size of the upper-side clutching blocks is the same as a size of the lower-side clutching blocks; and the upper-side clutching column can slide down to completely embed into the lower-side clutching column, at which time the lower-side clutching column can drive the upper-side clutching column to rotate synchronously, wherein the clutching spring is sleeved on an outer side of the driving rod, and upper and lower ends of the clutching spring are in slidable contact with a lower-end surface of the rotating mounting plate and an upper-end surface of the sliding sleeve respectively, wherein a middle part of an outside cylindrical surface of the sliding sleeve is provided with one annular sliding groove; one sliding block is slidably inserted into interiors of left and right sides of the sliding groove respectively; and one side of each sliding block away from the sliding sleeve is rotationally provided with one square third sliding block.

7. The processing device for the flange according to claim 6, further comprising:

one hinge base, a fourth sliding groove, one vertical upper-side snapping groove, one vertical lower-side snapping groove, one snapping block, one concave groove, one left-right horizontal fifth sliding rod, wherein the shifting fork is arranged between the sliding sleeve and a front-end surface of the rotation frame, and the shifting fork comprises one U-shaped segment and one linear segment, wherein one end of the linear segment is fixedly connected to a middle part of the U-shaped segment, and the other end of the linear segment extends to the front-end surface of the rotation frame; and two ends of the U-shaped segment are separately located on outer sides of two sliding blocks, and one third sliding groove is separately arranged at two ends of the U-shaped segment, wherein third sliding blocks on the two sliding blocks are slidably arranged in interiors of two third sliding grooves respectively, wherein one hinge hole is arranged in a middle part of the linear segment;

the hinge base is fixedly arranged at a lower-end surface of the rotating mounting plate; and the hinge hole in the middle part of the linear segment is rotationally connected to the hinge base by a pin, wherein the fourth sliding groove is arranged at one end of the linear segment close to the sliding sleeve, and the clutching oil cylinder is fixedly arranged on an upper end of the rotating mounting plate, wherein a cylinder body of the clutching oil cylinder is fixed at an upper-end surface of the rotating mounting plate; a piston rod of the clutching oil cylinder vertically passes downward through the rotating mounting plate; and a lower end of the piston rod of the clutching oil cylinder is fixedly provided with one left-right horizontal fourth sliding rod, wherein the fourth sliding rod is slidably inserted into an interior of the fourth sliding groove, wherein the vertical upper-side snapping groove is arranged in a lower end of a middle part of a front-end surface of the rotation frame;

the vertical lower-side snapping groove is arranged in an upper end of a middle part of the accommodation slot of the driving frame; and both the upper-side snapping groove and the lower-side snapping groove are trapezoidal grooves with wider interiors and narrower exteriors, wherein the snapping block is slidably arranged inside a junction of the lower-side snapping groove and the upper-side snapping groove;

the concave groove is arranged in an outer side surface of the snapping block; the left-right horizontal fifth sliding rod is fixedly arranged inside the groove; and one end of the linear segment of the shifting fork away from the sliding sleeve is provided with a fifth sliding groove, wherein the fifth sliding rod is slidably inserted into an interior of the fifth sliding groove.

8. The processing device for the flange according to claim 1, further, comprising:

an upper-side pressing oil cylinder, one vertical lifting oil cylinder and an upper-side bearing base, wherein the upper-side moving frame is slidably arranged on the rotation frame along a front-back direction, and the upper-side moving frame comprises one upper-side action rod, two left-right symmetrical upper-side moving rods, and one U-shaped frame, wherein two upper-side moving rods are both slidably inserted into an interior of the rotation frame along a front-back horizontal direction;

the upper-side action rod is fixedly arranged between back ends of the two upper-side moving rods; and the U-shaped frame is a U-shaped structure opening downward, and two lower ends of the U-shaped frame are fixedly connected to front ends of the two upper-side moving rods respectively, wherein the upper-side pressing oil cylinder is arranged between a back-end surface of the rotation frame and the upper-side action rod;

the lifting table is slidably arranged within an interior of the U-shaped frame; the vertical lifting oil cylinder is arranged between a top surface inside the U-shaped frame and the lifting table;

the upper-side bearing base is fixedly arranged on a lower-end surface of the lifting table; and the upper-side driven roller is rotationally arranged within an interior of the upper-side bearing base.

9. The processing device for the flange according to claim 8, wherein the inner-supporting clamping mechanism comprises an inner-supporting plate, a connecting rod, an inner-supporting oil cylinder, a sliding column, a telescopic rod, a fixing cylinder, four circularly arrayed passing grooves, and one linkage ring wherein the four circularly arrayed square grooves are arranged in a lower-side region of a side wall of the upper-side driven roller;

one inner-supporting plate is separately arranged in an interior of each square groove;

one fixing cylinder is fixedly arranged at an internal axis of the upper-side driven roller; and outer sides of upper and lower ends of the fixing cylinder are separately fixedly connected to an inner wall of the upper-side driven roller by one fixing ring, wherein four circularly arrayed passing grooves are arranged on a side wall of the fixing cylinder, and the four passing grooves are corresponding to four inner-supporting plates; and one vertical sliding column is slidably arranged in an interior of the fixing cylinder, and two connecting rods parallel above and below are both arranged between an outer side surface of the sliding column and each inner-supporting plate, wherein one end of the connecting rod is hinged to an outside cylindrical surface of the sliding column, and the other end of the connecting rod is hinged to an inner side surface of the inner-supporting plate after passing through a corresponding passing groove, wherein the inner-supporting oil cylinder is fixedly arranged on an upper-end surface of the lifting table;

a cylinder body of the inner-supporting oil cylinder is fixed to the upper-end surface of the lifting table; and a piston rod of the inner-supporting oil cylinder vertically passes downward through the upper-side bearing base and then extends into an interior of the upper-side driven roller, wherein one linkage sleeve is fixedly arranged on a lower end of the piston rod of the inner-supporting oil cylinder;

the linkage sleeve is a cylindrical structure opening at a lower end; and an inner wall of the linkage sleeve is provided with one annular linkage groove, wherein ewe the linkage ring is fixedly arranged on an upper end of an outside cylindrical surface of the sliding column;

the linkage ring is slidably snapped to an interior of the linkage groove; and a lower end of the fixing cylinder is fixedly provided with four telescopic rods, wherein the four telescopic rods are all arranged along a radial direction of the fixing cylinder;

telescopic ends of the four telescopic rods are separately fixedly connected to inner side surfaces of the four inner-supporting plates; and fixing ends of the four telescopic rods are fixedly connected to a lower end of the fixing cylinder.

10. The processing device for the flange according to claim 9, wherein the fixing table is a block structure in a U-shape, wherein a middle part of a back-end surface of the fixing table is provided with one square lower-side avoidance groove;

one lower-side moving frame is slidably arranged in an interior of the lower-side avoidance groove of the fixing table along a front-back direction; and the lower-side moving frame comprises one lower-side action rod, two left-right symmetrical lower-side moving rods, and one lower-side moving base, wherein the two lower-side moving rods are both slidably inserted into an interior of the driving frame along a front-back horizontal direction; the lower-side action rod is fixedly arranged between back ends of the two lower-side moving rods; and the lower-side moving base is fixedly arranged between front ends of the two upper-side moving rods, wherein a lower-side pressing oil cylinder is arranged between the driving frame and the lower-side action rod of the lower-side moving frame;

a lower-side bearing base is fixedly arranged on an upper end of the lower-side moving base;

the lower-side driven roller is rotationally arranged in an interior of the lower-side bearing base; and the butting mechanism is arranged between a lower end of the upper-side driven roller and an upper end of the lower-side driven roller, wherein the butting mechanism comprises an upper-side butting column and a lower-side butting column, wherein the upper-side butting column is fixedly arranged in an interior of the lower end of the upper-side driven roller;

the upper-side butting column is a cylindrical structure opening at a lower end; and the lower end of the upper-side butting column is provided with two centrally symmetrical spiral grooves, wherein the lower-side butting column is fixedly arranged in an interior of an upper end of the lower-side driven roller;

the lower-side butting column is a cylindrical structure opening at an upper end; and the upper end of the lower-side butting column is provided with two centrally symmetrical spiral grooves, wherein when the upper-side driven roller butts with the lower-side driven roller, the two spiral grooves of the upper-side butting column are embedded into the two spiral grooves of the lower-side butting column, and the lower end of the upper-side driven roller is in contact with the upper end of the lower-side driven roller.

* * * * *